US008179411B2

(12) United States Patent
Takabatake et al.

(10) Patent No.: US 8,179,411 B2
(45) Date of Patent: May 15, 2012

(54) PRINTER MODULE AND ELECTRONIC APPARATUS

(75) Inventors: Yoshinari Takabatake, Shinagawa (JP); Yukihiro Mori, Shinagawa (JP); Sumio Watanabe, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 285 days.

(21) Appl. No.: 12/622,475

(22) Filed: Nov. 20, 2009

(65) Prior Publication Data

US 2010/0141728 A1 Jun. 10, 2010

(30) Foreign Application Priority Data

Dec. 5, 2008 (JP) ..... 2008-311406

(51) Int. Cl.
*B41J 2/325* (2006.01)

(52) U.S. Cl. ..... 347/220

(58) Field of Classification Search ..... 347/220, 347/222, 197, 198
See application file for complete search history.

(56) References Cited

U.S. PATENT DOCUMENTS 5,198,836 A * 3/1993 Saito et al.
5,248,207 A * 9/1993 Yamamoto et al.
6,118,469 A * 9/2000 Hosomi
7,273,325 B2 9/2007 Watanabe et al.

FOREIGN PATENT DOCUMENTS

JP 2003-145815 A 5/2003
JP 2005-81774 A 3/2005

OTHER PUBLICATIONS

Office Action dated Oct. 21, 2011 issued with respect to the corresponding Korean Patent Application No. 10-2009-0119985.

* cited by examiner

*Primary Examiner* — Kristal Feggins
(74) *Attorney, Agent, or Firm* — IPUSA, PLLC

(57) ABSTRACT

A printer module for a clam-shell type printing apparatus having a lid that opens and closes with respect to a housing, includes a head assembly including a head and mounted on the housing, a platen roller mounted on the lid, and a main assembly including a frame and a motor mounted on the frame to rotate the platen roller. The main assembly is arranged to cover the head assembly and is mounted on the housing.

19 Claims, 30 Drawing Sheets

Z1
Y1
Y2
Z2

39
56
55
32
95
72
71
57
77
75A
78

PRINTER MODULE AND ELECTRONIC APPARATUS

CROSS-REFERENCE TO RELATED APPLICATIONS

This application claims the benefit of a Japanese Patent Application No. 2008-311406 filed on Dec. 5, 2008, in the Japanese Patent Office, the disclosure of which is hereby incorporated by reference.

BACKGROUND OF THE INVENTION

1. Field of the Invention

The present invention generally relates to printer modules and electronic apparatuses, and more particularly to a printer module applicable to a clam-shell type printing apparatus, and an electronic apparatus having such a printer module.

2. Description of the Related Art

The clam-shell type printing apparatus is formed by a main body and a lid that is configured to open and close with respect to the main body. Each of the main body and the lid is mounted with a module. The modules of the main body and the lid are connected to form the printing apparatus when the lid is closed.

The clam-shell type printing apparatus is employed in both desk-top electronic apparatuses and portable electronic apparatuses. When employed in the portable electronic apparatus, there are demands to make the clam-shell type printing apparatus compact.

Conventional printer modules of the clam-shell type printing apparatus are formed by a combination of a first module and a second module. The first module has a thermal head, a head pressing left spring member, a motor, a gear mechanism, a platen roller lock mechanism and the like assembled in a frame. On the other hand, the second module has a platen roller and the like.

An example of a thermal printing apparatus is proposed in a Japanese Laid-Open Patent Publication No. 2005-81774.

Because the first module includes the thermal head and the head pressing leaf spring member in addition to the motor, the gear mechanism and the platen roller lock mechanism, the size of the first module becomes relatively large. For this reason, it was difficult to reduce the size of the printer module and lower the height of the printer module. In addition, a paper roll is accommodated within a space outside the first and second modules that are combined, such as a space under the combination of the first and second modules. Consequently, it was difficult to reduce the size of the printing apparatus, and particularly difficult to lower the height of the printing apparatus.

SUMMARY OF THE INVENTION

Accordingly, it is a general object of the present invention to provide a novel and useful printer module and electronic apparatus, in which the problems described above are suppressed.

Another and more specific object of the present invention is to provide a printer module and an electronic apparatus which can be made compact, and enable the height to be lowered.

According to one aspect of the present invention, there is provided a printer module for a clam-shell type printing apparatus having a lid that opens and closes with respect to a housing, comprising a head assembly including a head and mounted on the housing; a platen roller mounted on the lid; and a main assembly including a frame, and a motor mounted on the frame and configured to rotate the platen roller, wherein the main assembly is arranged to cover the head assembly and is mounted on the housing.

According to another aspect of the present invention, there is provided an electronic apparatus comprising a housing; and a printer module for a clam-shell type printing apparatus having a lid that opens and closes with respect to the housing, the printer module comprising a head assembly including a head and mounted on the housing; a platen roller mounted on the lid; and a main assembly including a frame, and a motor mounted on the frame and configured to rotate the platen roller, wherein the main assembly is arranged to cover the head assembly and is mounted on the housing.

Other objects and further features of the present invention will be apparent from the following detailed description when read in conjunction with the accompanying drawings.

DESCRIPTION OF THE PREFERRED EMBODIMENTS

First Embodiment

Figure 1A:
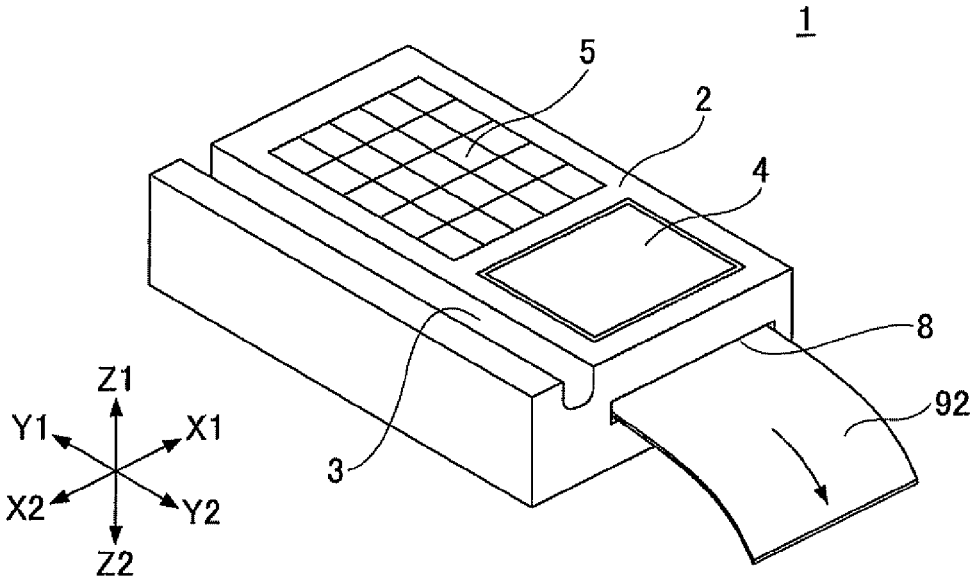
FIGS. 1A and 1B are a perspective view and a cross sectional side view illustrating a credit card settlement apparatus applied with a thermal printer module in a first embodiment of the present invention.
Figure 1B:
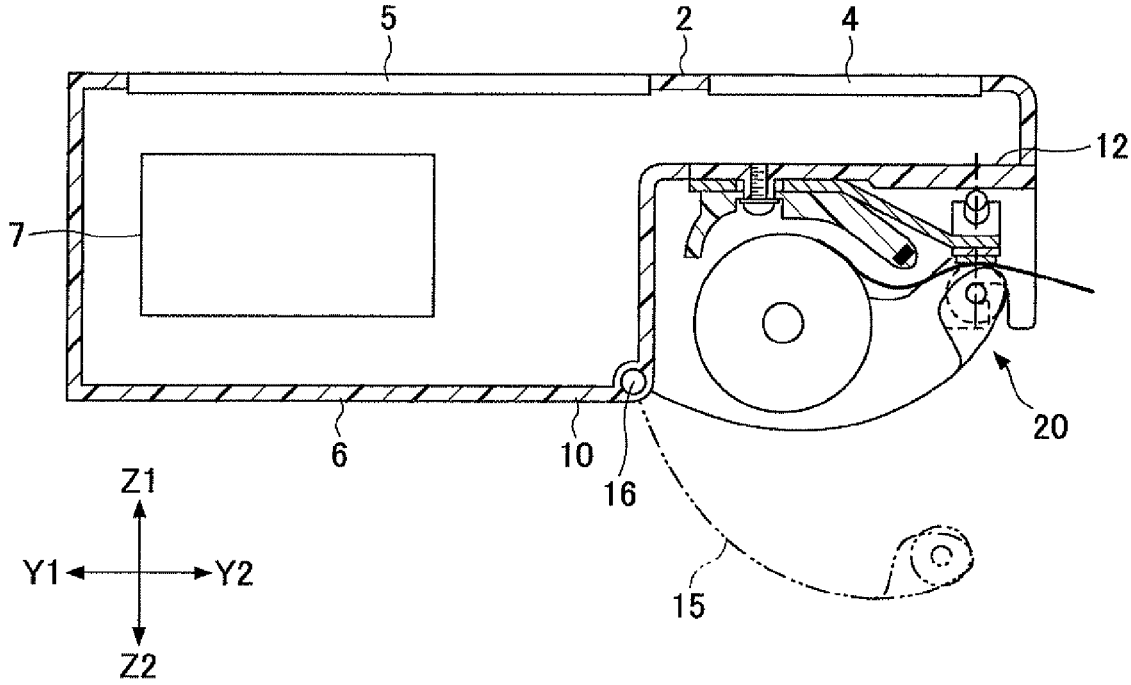

FIGS. 1A and 1B are a perspective view and a cross sectional side view illustrating a credit card settlement apparatus 1 which is an example of an electronic apparatus applied with a thermal printer module 30 in a first embodiment of the present invention. X1-X2 corresponds to a width direction, Y1-Y2 corresponds to a longitudinal direction, and Z1-Z2 corresponds to a height direction.

The credit card settlement apparatus 1 is a portable type apparatus having a flat parallelepiped (or box) shape, and may be held by one hand of an operator while the operator operates the credit card settlement apparatus 1 with the other hand. The credit card settlement apparatus 1 has an upper surface 2 provided with a credit card reader 3 which magnetically reads a number or the like of a credit card (not illustrated) that is scanned, a liquid crystal display (LCD) 4, and a keypad 5. The credit card reader 3 is provided on the X2 side of the upper surface 2, the LCD 4 is provided on the Y2 side of the upper surface 2, and the keypad 5 is provided on the Y1 side of the upper surface 2. The credit card settlement apparatus 1 has a lower surface 6 provided with a thermal printing apparatus 20, and the thermal printing apparatus 20 is provided on the Y2 side of the lower surface 6. A battery 7 is assembled within the credit card settlement apparatus 1.

When the number or the like of the credit card is read by the credit card reader 3 and the operator makes an input from the keypad 5, the thermal printing apparatus 20 operates to output printed paper 92 from an outlet 8.

Because the thermal printing apparatus 20 is provided on the Y2 side of the lower surface 6, the entire upper surface 2 of the credit card settling apparatus 1 may be utilized for a display device, an input device and the like. In order to arrange the thermal printing apparatus 1 in this manner, a housing 10 of the thermal printing apparatus 1 has a recess 11 for accommodating a thermal printer module 30, and a lid 15 that is configured to open and close to cover the recess 11, respectively located on the Y2 side of the lower surface 6. A flat plate part 12 is formed at the bottom of the recess 11 of the housing 10 when viewed from the lower surface 6. The lid 15 is supported on a shaft 16 which is located at an edge of the recess 11 in the lower surface 6, to pivot about the shaft 16.

[Thermal Printer Module 30]

Figure 2:
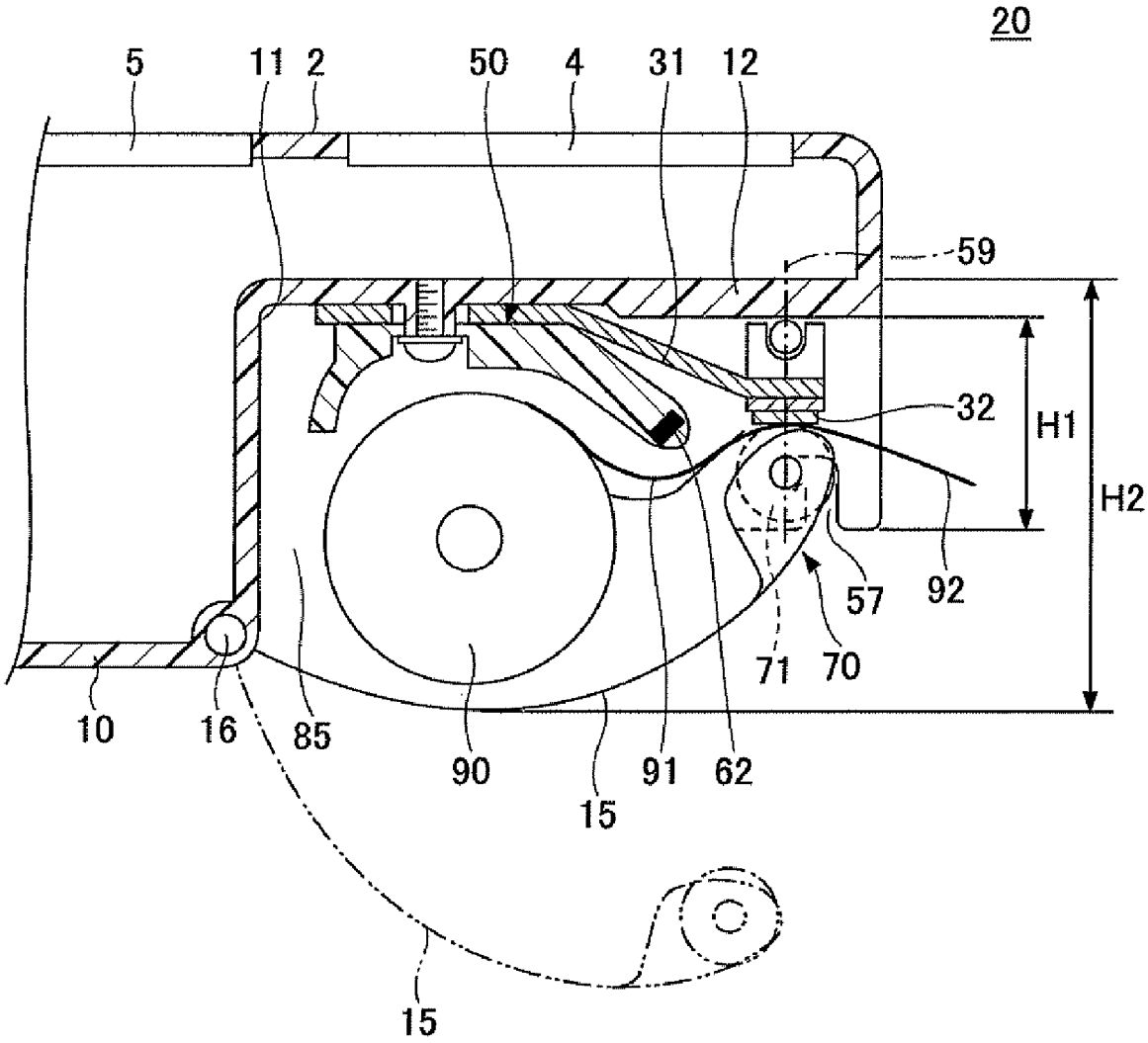
FIG. 2 is a cross sectional view, on an enlarged scale, illustrating the thermal printing apparatus of FIG. 1B.
Figure 3:
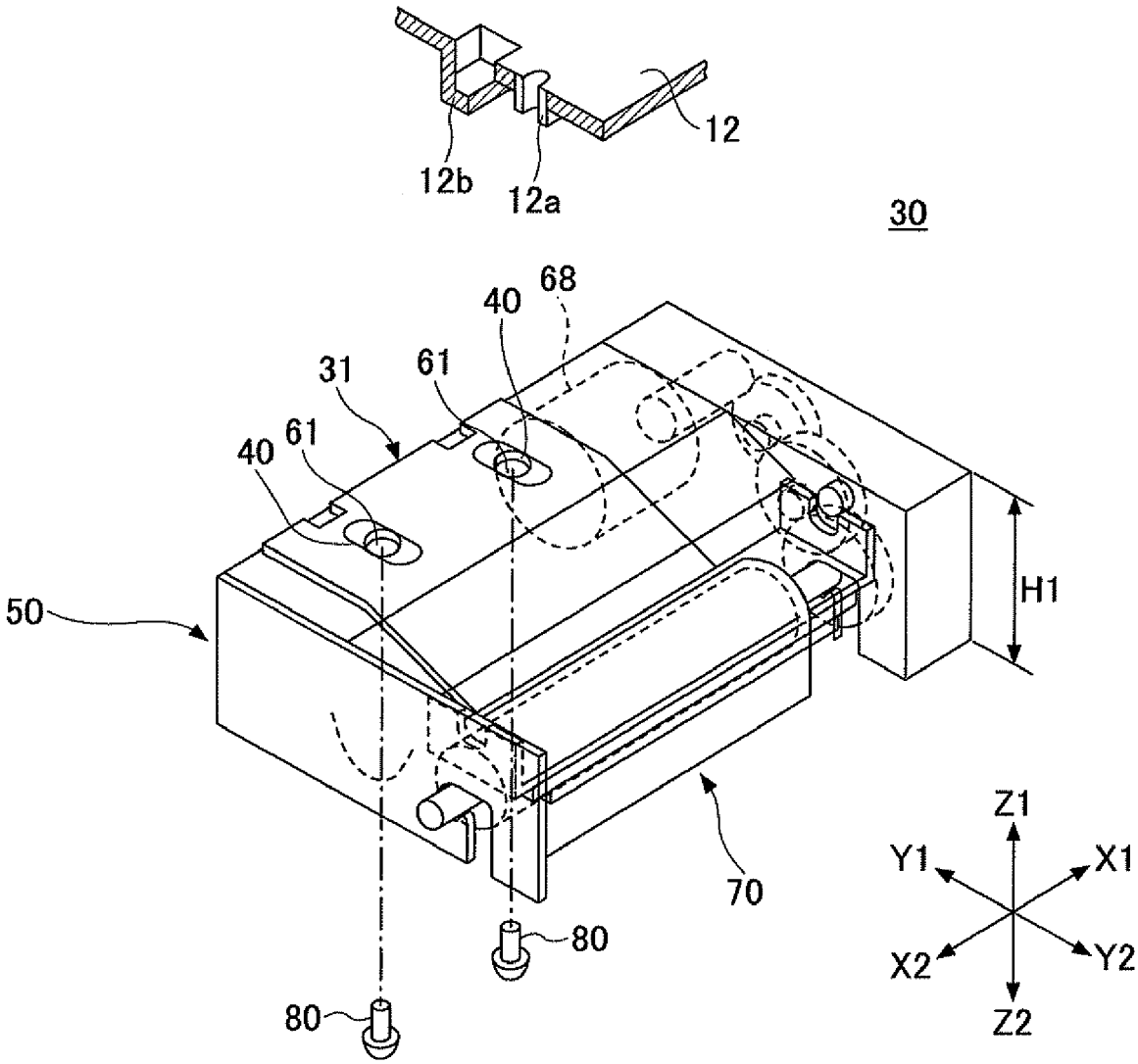
FIG. 3 is a perspective view of the thermal printer module in the first embodiment of the present invention.
Figure 4:
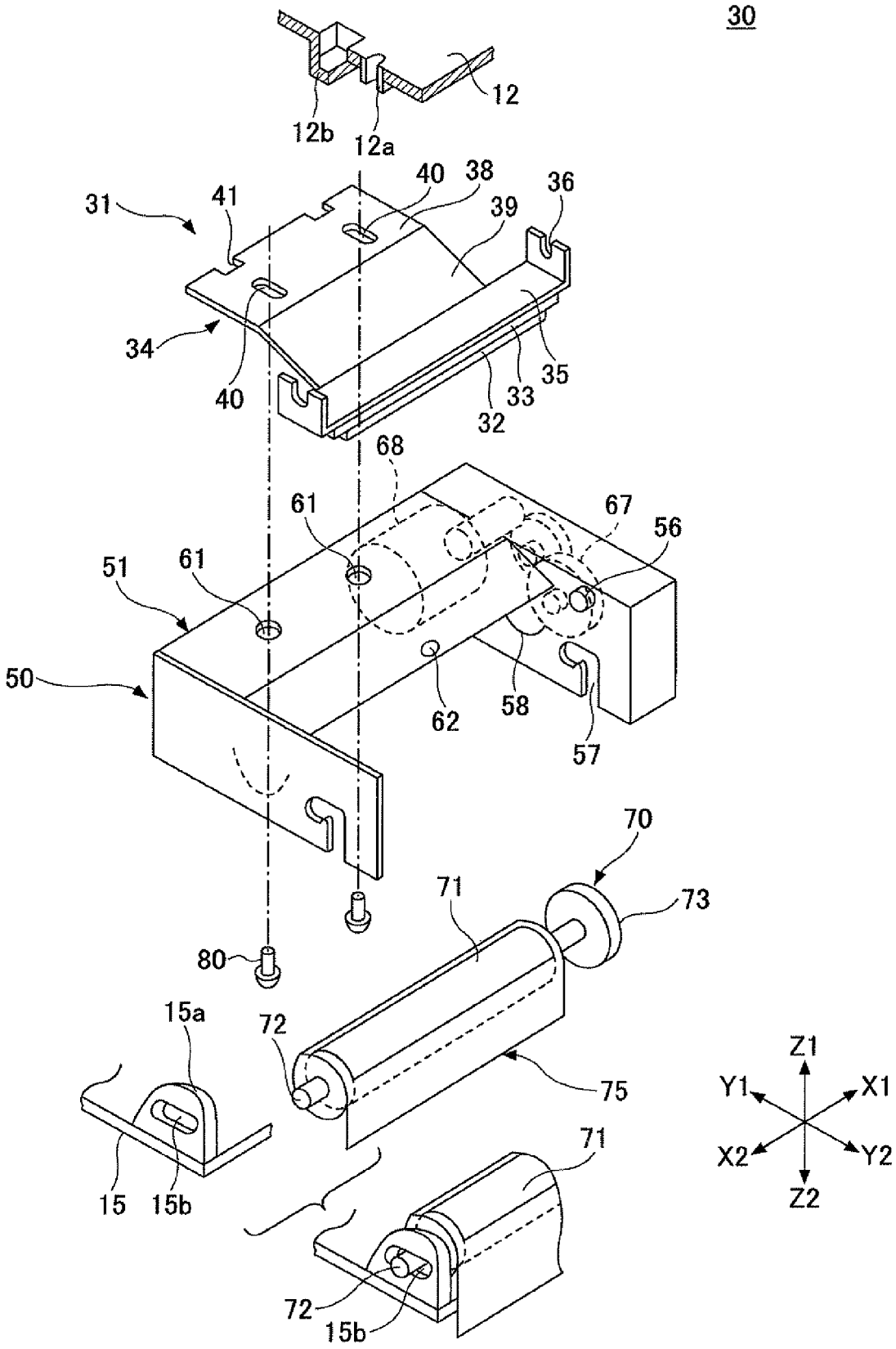
FIG. 4 is a disassembled perspective view of the thermal printer module of FIG. 3.

FIG. 2 is a cross sectional view, on an enlarged scale, illustrating the thermal printing apparatus 20 of FIG. 1B. FIG. 3 is a perspective view of the thermal printer module 30, and FIG. 4 is a disassembled perspective view of the thermal printer module 30 of FIG. 3.

The thermal printer module 30 includes a thermal head assembly 31, a main assembly 50, and a platen roller assembly 70. As will be described later, the thermal head assembly 31 is mounted, together with the main assembly 50, on the housing 10 of the credit card settlement apparatus 1. The platen roller assembly 70 is mounted on a tip end of the lid 15. The thermal printer apparatus 20 is formed in a state where the lid 15 is closed.

[Thermal Head Assembly 31]

Figure 5:
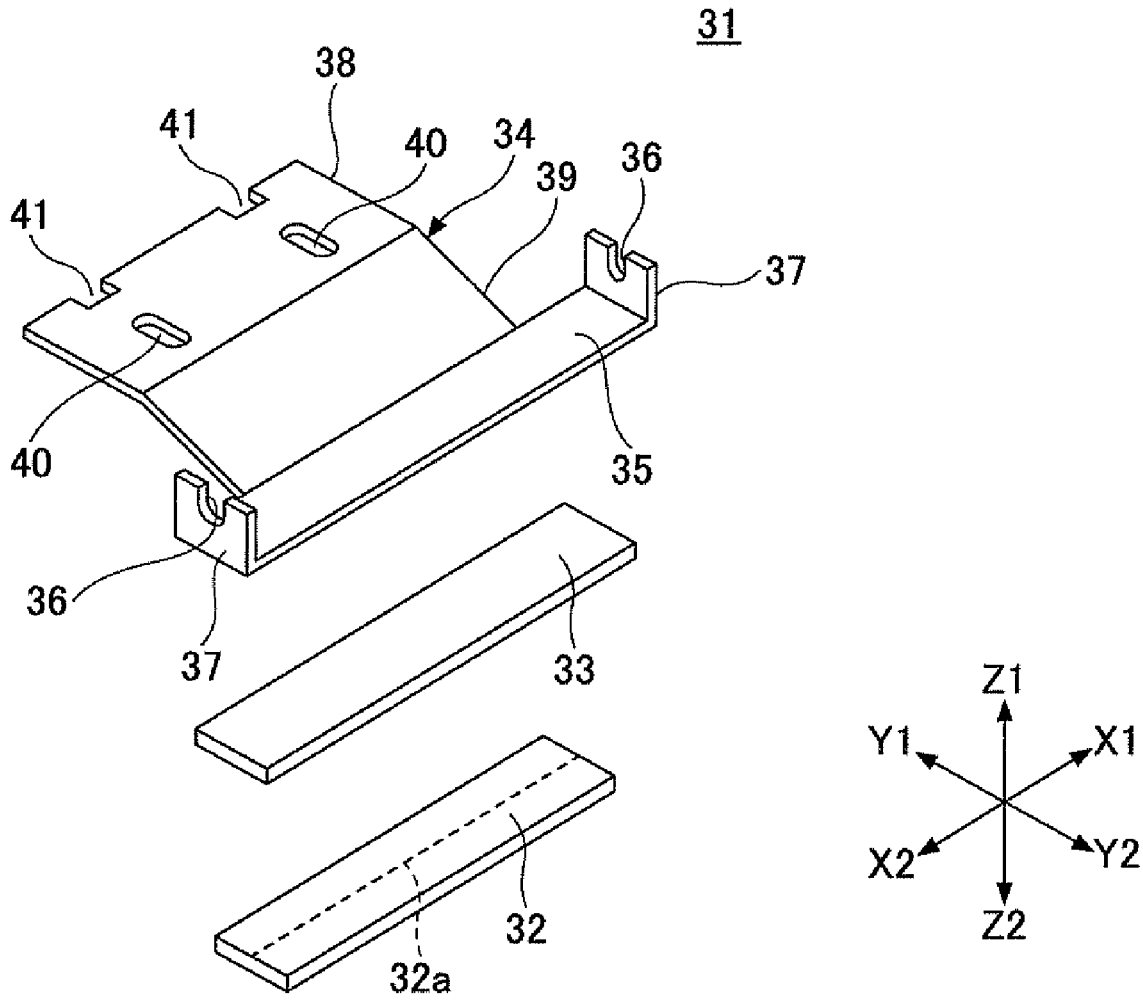
FIG. 5 is a disassembled perspective view of a thermal head assembly.

FIG. 5 is a disassembled perspective view of the thermal head assembly 31. As illustrated in FIGS. 4 and 5, the thermal head assembly 31 includes a thermal head 32 fixed on a radiator plate (or heat sink) 33, and the radiator plate 33 is fixed on a head mounting part 35 provided on a tip end of a head pressing leaf spring member 34. The fixing of the thermal head 32 on the radiator plate 33 and the fixing of the radiator plate 33 on the head mounting part 35 may be made by adhesion. The head mounting part 35 includes a positioning recess 36 located on both X1-X2 sides, and the thermal head 32 is mounted so that a heater part 32*a* matches an imaginary line connecting the positioning recesses 36 on both sides. The positioning recess 36 is formed on the Z1 side of a bent part 37 of the head mounting part 35 that is bent in the Z1 direction.

The leaf spring member 34 includes a plate-shaped base 38 on the Y1 side, a leaf spring arm 39 extending obliquely downwards in the Y2 direction from the plate-shaped base 38, and the head mounting part 35 provided on the tip end of the leaf spring arm 39. The plate-shaped part 38 includes two mounting holes 40 elongated in the Y1-Y2 direction and formed side-by-side in the X1-X2 direction, and two cutouts 41 formed at an edge thereof on the Y1 side. A Flexible Printed Circuit (FPC, not illustrated) extends from the thermal head 32.

[Main Assembly 50]

Figure 6:
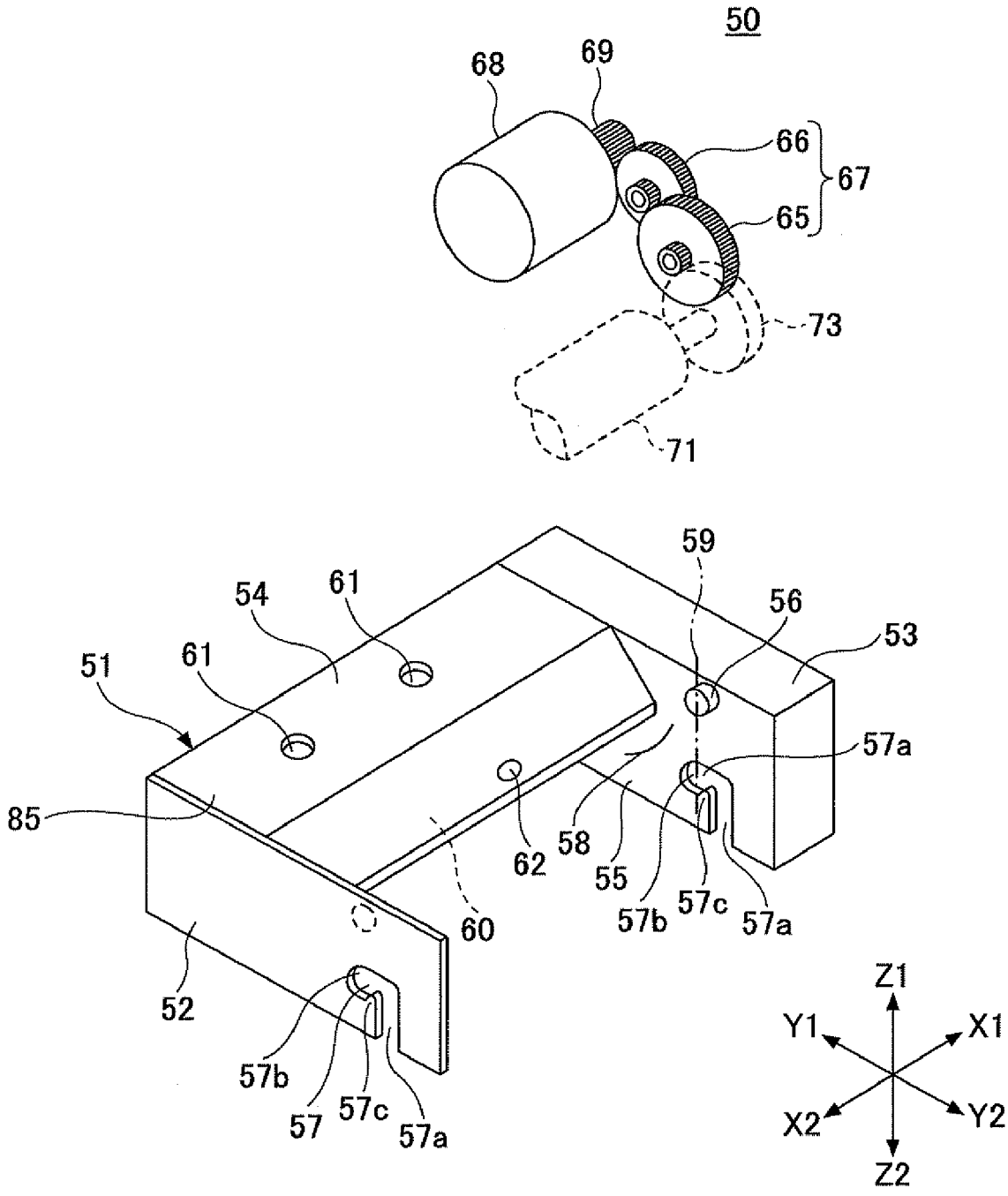
FIG. 6 is a disassembled perspective view of a main assembly.

FIG. 6 is a disassembled perspective view of the main assembly 50. As illustrated in FIGS. 4 and 6, the main assembly 50 has a frame 51 having a U-shape when viewed from the Z1 side, and a reduction gear mechanism (or gear group) 67 and a pulse motor 68 that are mounted on the frame 51.

The frame 51 is made of a synthetic resin, for example, and includes a side plate part 52 on the X2 side, a gear accommodating box part 53 on the X1 side, and a paper guide part (or lateral bridge part) 54 bridging the side plate part 52 and the box part 53. The box part 53 includes a side plate part 55 on the X2 side.

Mutually opposing surfaces of the side plate parts 52 and 55 have a reference pin-shaped projection (or reference projection) 56, a locking cutout part 57, and a holder guide part 58. The projections 56, the locking cutout parts 57, and the holder guide parts 58 are formed at matching positions on the mutually opposing surfaces of the side plate parts 52 and 55 when viewed from the X2 side.

The projection 56 is arranged at a position closer to the edge on the Z1 side of each of the side plate parts 52 and 55.

The locking cutout part 57 has an upside-down L-shape with an entrance 57*a* on the Z2 side, a shaft lock part 57*b* at an end of a portion extending in the Y1 direction for holding a shaft of a platen roller 170, and a convex part 57*c* on the Y2 side of the shaft lock part 57*b*. The projection 56 and the shaft lock part 57*b* are located on a Z-axis 59 passing a center of the projection 56.

The holder guide part 58 has a stepped shape, and is arranged at a position close to the shaft holding part 57 but more on the Y1 side than the shaft lock part 57*b*. In addition, the holder guide part 58 extends in the direction of the projection 56, and as will be described later, guides a holder 75 when unlocking the platen roller 170.

Figure 8:
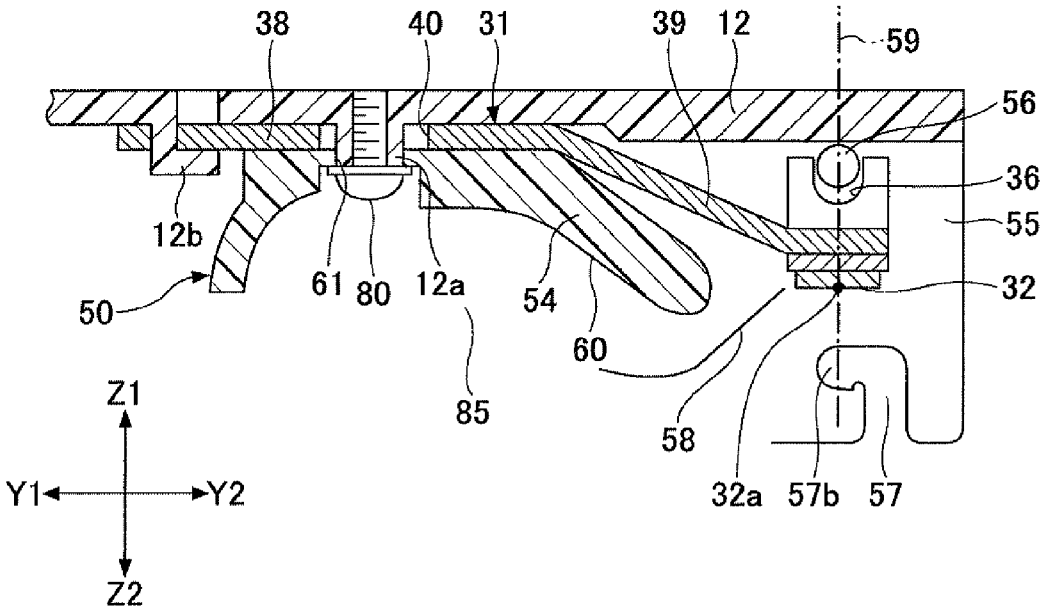
FIG. 8 is a cross sectional view illustrating a state where the thermal head assembly and the main assembly are mounted on a housing.

The paper guide part 54 has on a lower surface thereof a paper guide surface 60 which is curved to guide the paper, as illustrated in FIG. 8 which will be described later. In addition, the paper guide part 54 has two circular mounting holes 61 at positions on the Y1 side, arranged side-by-side in the X1-X2 direction in correspondence with the mounting holes 40. The paper guide part 54 further has a photosensor 62 for detecting a heat sensitive paper 91, arranged on the Y2 side.

A part surrounded by the opposing side plate parts 52 and 55 and the paper guide part 54 forms a portion of a paper roll accommodating space 85.

The reduction gear mechanism 67, including gears 65 and 66, is assembled within the box part 53. The pulse motor 68 is fixed on the side plate part 55 at a position closer to the edge on the Y1 side. A gear 69 which is fixed on a rotary shaft of the pulse motor 68 meshes with the gear 66. The pulse motor 68 rotates the platen roller 71, and the reduction gear mechanism 67 reduces the rotation of the pulse motor 68 transmitted to the platen roller 71.

[Platen Roller Assembly 70]

Figure 7:
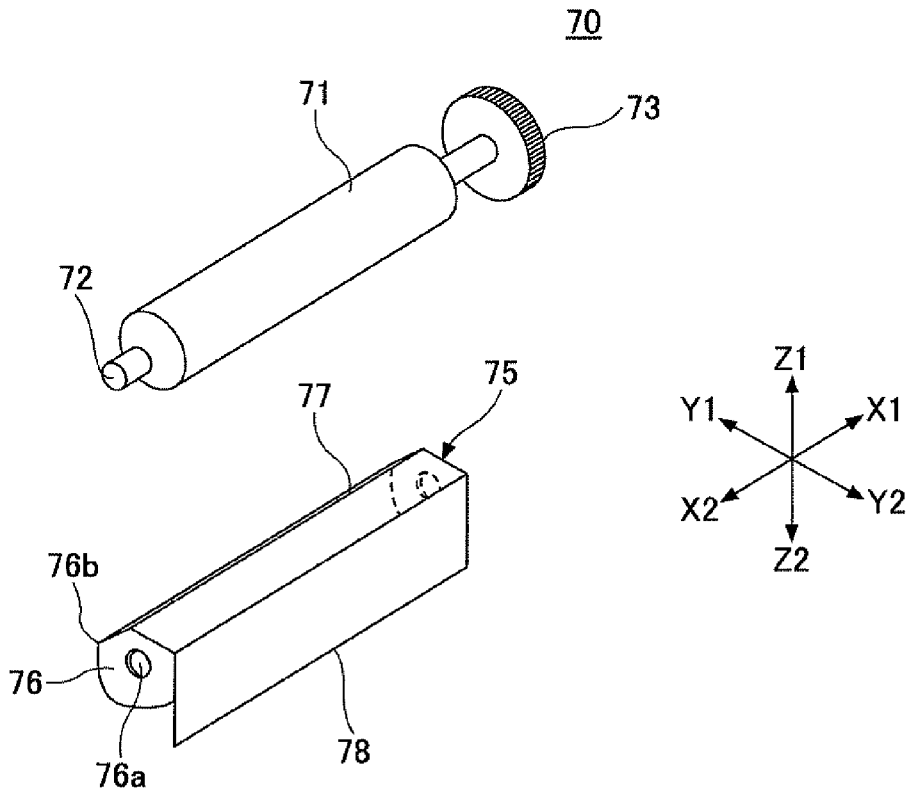
FIG. 7 is a disassembled perspective view of a platen roller assembly.

FIG. 7 is a disassembled perspective view of the platen roller assembly 70. As illustrated in FIGS. 4 and 7, the platen roller assembly 70 has the platen roller 71 mounted on the holder 75. The platen roller 71 has a platen roller shaft 72 and a gear 73. The platen roller shaft 72 penetrates the platen roller 71 and projects on both side thereof. The gear 73 is fixed on an end of the platen roller shaft 72 on the X1 side. The holder 75 is made of a synthetic resin, for example, and includes a flange part 76 on both sides along the X1-X2 direction, a paper jam preventing part 77 laterally bridging the flange parts 76 on both sides, and an operation part 78. The paper jam preventing part 77 has an approximate cylindrical shape with a semi-circular cross section. The operation part 78 is pushed by a finger-tip of the operator, for example, when turning the holder 75 clockwise. The operation part 78 projects outwardly in the Z2 direction in FIG. 7.

Both ends of the platen roller shaft 72 are supported by the flange parts 76 at holes 76*a* in the flange parts 76, and the platen roller 71 is accommodated within the holder 75. The platen roller shaft 72 fits into the holder 75 which surrounds the platen roller 71. The flange part 76 has a corner portion 76*b* projecting in a radial direction.

[Thermal Printing Apparatus 20]

As illustrated in FIG. 2, the thermal printing apparatus 20 includes the thermal head assembly 31 mounted on the housing 10 of the credit card settlement apparatus 1, the main assembly 40 mounted on the housing 10 of the credit card settlement apparatus 1, and the platen roller assembly 70 mounted on the tip end of the lid 15.

The thermal head assembly 31 is arranged along the plate part 12, and the platen roller assembly 70 moves in the Z1 direction to be positioned to its final position when the lid 15 is closed. For this reason, a height H1 of the thermal printer module 30 is reduced and lower than that of the conventional thermal printer module. In addition, because the paper roll accommodating space 85 is formed within the height range of the frame 51 of the main assembly 40 as will be described later, a height H2 of the printing apparatus 20 is reduced and lower than that of the conventional printing apparatus.

In this embodiment, the flange parts 15*a* of the lid 15 are located on the outer sides of the side plate part 52 and the box part 53 when the lid 15 is closed. But for example, the flange part 15*a* may be located on the inner side of the side plate part 52, that is, on the X1 side of the side plate part 52 when the lid 15 is closed.

[Mounting of the Thermal Head Assembly 31 and the Main Assembly 40 on the Housing 10 of the Credit Card Settlement Apparatus 1]

As illustrated in FIGS. 3 and 4, a cylindrical boss 12*a* and a hook 12*b* are formed on the plate part 12 of the housing 10 of the credit card settlement apparatus 1, in correspondence with the mounting hole 40 and the cutout 41 in the thermal head assembly 31.

Figure 9:
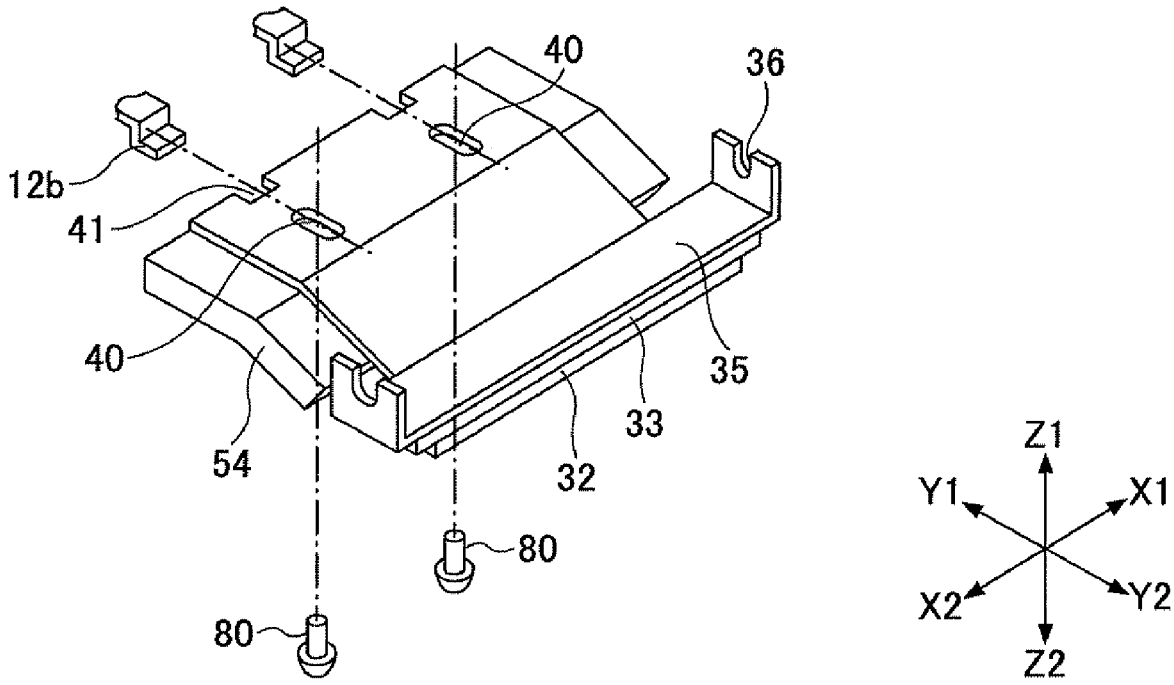
FIG. 9 is a perspective view for explaining mounting of the thermal head assembly and the main assembly on the housing.

As illustrated in FIGS. 8 and 9, the cutouts 41 of the thermal head assembly 31 engage the hooks 12*b*, and the thermal head assembly 31 is mounted on the housing 10 by screws 80 together with the main assembly 50. FIG. 8 is a cross sectional view illustrating a state where the thermal head assembly 31 and the main assembly 50 are mounted on the housing 10, and FIG. 9 is a perspective view for explaining mounting of the thermal head assembly 31 and the main assembly 50 on the housing 10. The thermal head assembly 31 and the main assembly 50 are mounted on the housing 10 of the credit card settlement apparatus 1 from the top side after orienting the credit card settlement apparatus 1 in an upside-down position. However, to be in accord with the illustrations in FIGS. 1A, 1B and 2 and for the sake of convenience, it is described and illustrated as if the thermal head assembly 31 and the main assembly 50 are mounted on the housing 10 of the credit card settlement apparatus 1 from the bottom side.

Figure 10A:
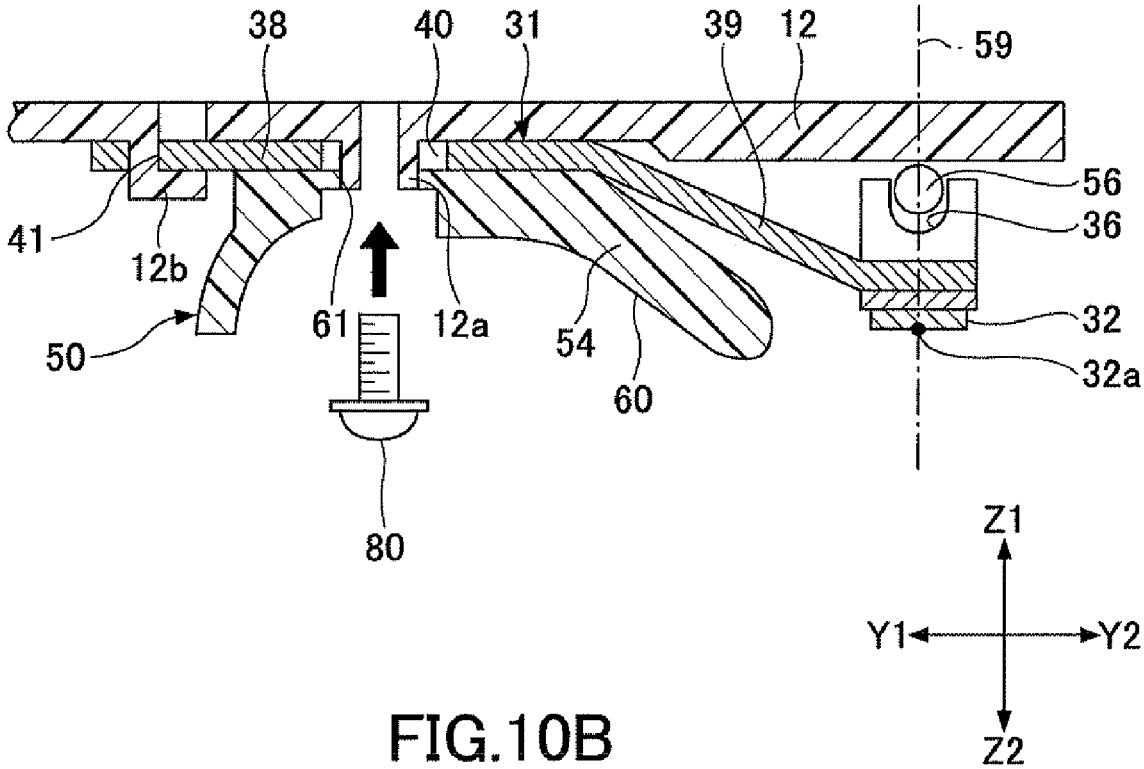
FIGS. 10A and 10B are cross sectional views for explaining mounting of the thermal head assembly on the housing.
Figure 10B:
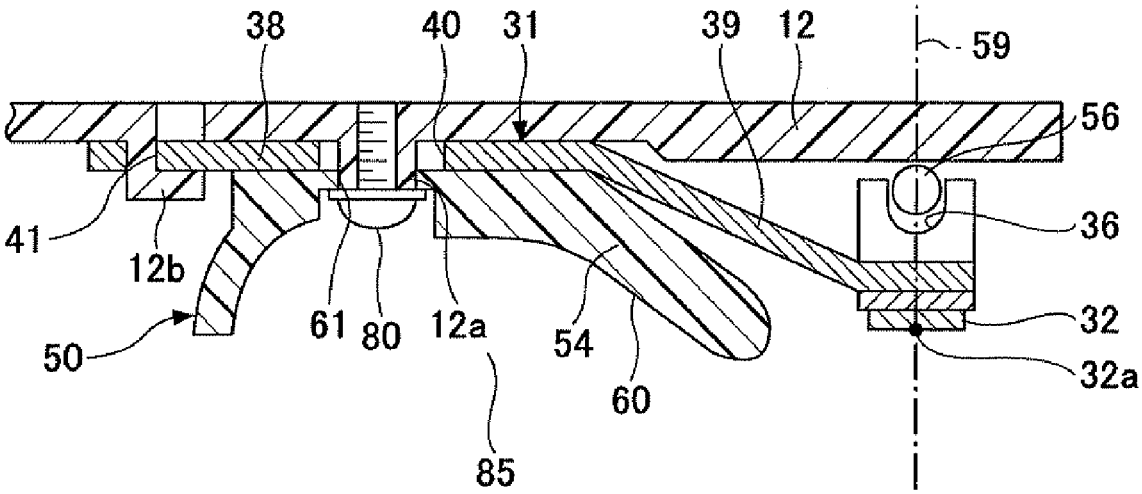

An assembling person engages the hooks 12*b* to the cutouts 41 and fits the bosses 12*a* into the mounting holes 40, in order to position the thermal head assembly 31, as illustrated in FIGS. 9 and 10A. FIGS. 10A and 10B are cross sectional views for explaining mounting of the thermal head assembly 31 on the housing 10. Then, the main assembly 50 is placed on top of the above structure by fitting the bosses 12*a* into the mounting holes 61 in the paper guide part 54 and fitting the reference pin-shaped projections 56 into the positioning recesses 61, in order to position the main assembly 50. Because the thermal head assembly 31 is movable slightly in the Y1-Y2 direction due to the relationship between the positioning holes 40 and the bosses 12*a*, the reference pin-shaped projections 56 fit smoothly into the positioning recesses 36. In this state, the screws 80 are screwed into the bosses 12*a* through the mounting holes 61 and the positioning holes 40, as illustrated in FIG. 10B.

Because the reference pin-shaped projections 56 fit into the corresponding positioning recesses 36, the thermal head assembly 31 is positioned to thereby align the corresponding positioning recesses 36, shaft lock parts 57*b* and reference pin-shaped projections 56 in the Z-axis 59. Hence, the heater part 32*a* of the thermal head 32 is positioned on the Z-axis 59.

A gap is formed between the Z2 side of the positioning recess 36 and the reference pin-shaped projection 56. Hence, in this state, the thermal head 32 may be displaced further towards the Z1-direction.

Therefore, the thermal head assembly 31 is sandwiched between the main assembly 50 and the plate part 12, and mounted on the housing 10 of the credit card settlement apparatus 1 in a state where the thermal head 32 is positioned with respect to the main assembly 50. In addition, the thermal head assembly 31 is arranged along and parallel to the plate part 12*b* at a height position that is slightly above the plate part 12 in the Z2 direction.

The main assembly 50 is mounted on the plate part 12 in a state covering the thermal head assembly 31.

The thermal printing apparatus 20 has a flat shape as illustrated in FIG. 2, because the paper roll accommodating space 85 is formed on the inside of the frame 51. In addition, the paper roll accommodating space 85 is formed below the paper guide part 54 of the main assembly 50 that is mounted on the plate part 12.

[Mounting of the Platen Roller Assembly 70 on the Lid 15]

As illustrated in FIG. 4, the lid 15 has a flange part 15*a* provided on both sides at the tip end thereof, and an elongated hole 15*b* formed in the flange part 15*a*. The platen roller assembly 70 is mounted on the tip end of the lid 15 by fitting the platen roller shaft 72 projecting from the holder 75 into the elongated hole 15*b*. The platen roller assembly 70 may be displaced within the range of the elongated hole 15*b* by manipulating the operation part 78, and the holder 75 may turn within a limited range.

Of course, the elongated hole 15*b* in the flange part 15*a* may be replaced by a circular hole, by making the shaft 16 of the lid 15 engage an elongated hole in place of a circular hole.

[Locking and Unlocking of the Lid 15 (or Platen Roller Shaft 72)]

The operator manipulates the operation part 78 after closing the lid 15. The platen roller assembly 70 is provided on the tip end of the lid 15 as described above, and the platen roller shaft 72 is positioned on the Y2 side within the elongated hole 15*b*.

Figure 11A:
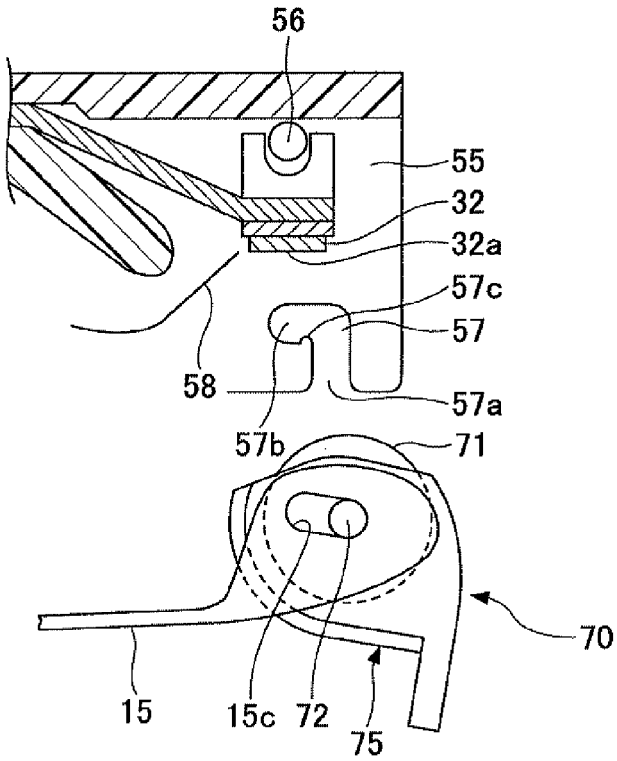
FIGS. 11A, 11B, 11C and 11D are cross sectional views for explaining locking of a platen roller shaft.
Figure 11B:
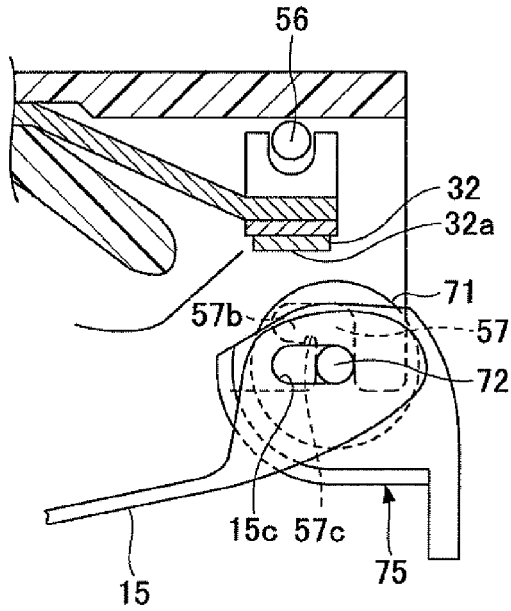
Figure 11B:
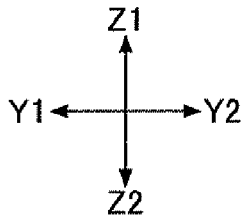

Hence, when the lid 15 is closed, the platen roller shaft 72 enters the locking cutout part 57 via the entrance 57*a*, as illustrated in FIGS. 11A and 11B. FIGS. 11A, 11B, 11C and 11D are cross sectional views for explaining locking of the platen roller shaft 72. In a state where the platen roller shaft 72 reaches the Z1 side of the entrance 57*a*, the platen roller assembly 70 is pushed in the Y1 direction as indicated by an arrow 100 in FIG. 11C. By this operation, the platen roller shaft 72 rides over the convex part 57*c* and moves to the shaft lock part 57*b*. As a result, the platen roller shaft 72 is restricted from moving in the Y2 direction by the convex part 57*c*, and is engaged by and locked by the shaft lock part 57*b* as illustrated in FIG. 11D. As the platen roller shaft 72 rides over the convex part 57*c*, the platen roller shaft 72 engages the shaft lock part 57*b* with a "click".

Figure 11C:
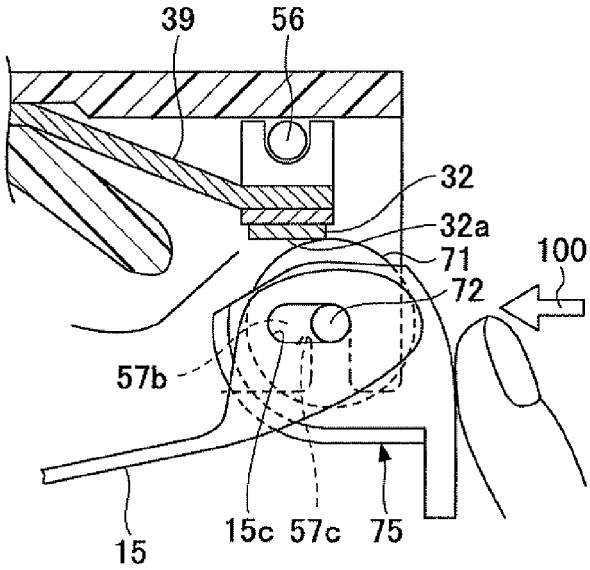
Figure 11D:
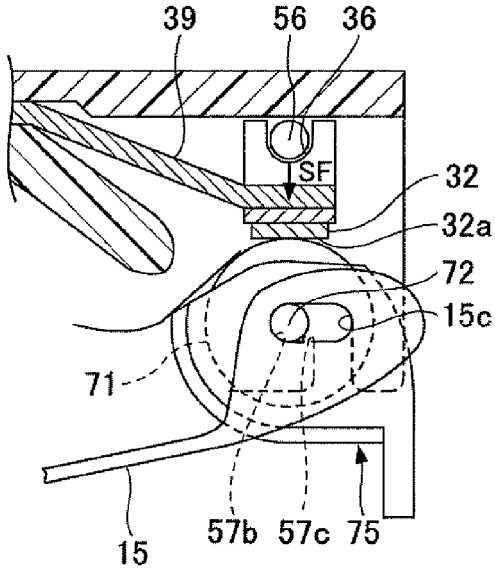

As illustrated in FIGS. 11C and 11D, the platen roller 71 slightly pushes against the thermal head 32. In this state, the leaf spring arm 39 is resiliently deformed or bent to generate a head spring force SF, to thereby push the platen roller 71 against the thermal head 32. The platen roller shaft 72 is positioned in the shaft lock part 57*b* by the head spring force SF and the convex part 57*c*, so that the center axis of the platen roller 71 is located on the Z-axis 59, and the platen roller 71 pushes against the heater part 32*a* of the thermal head 32.

In a final stage of closing the lid 15, the platen roller 71 moves approximately in the Z1-direction to approach the plate part 12, and pushes the thermal head 32 in the direction of the plate part 12 by making contact with the thermal head 32 which is approximately parallel to and positioned slightly above the plate part 12 in the Z2 direction.

Figure 12A:
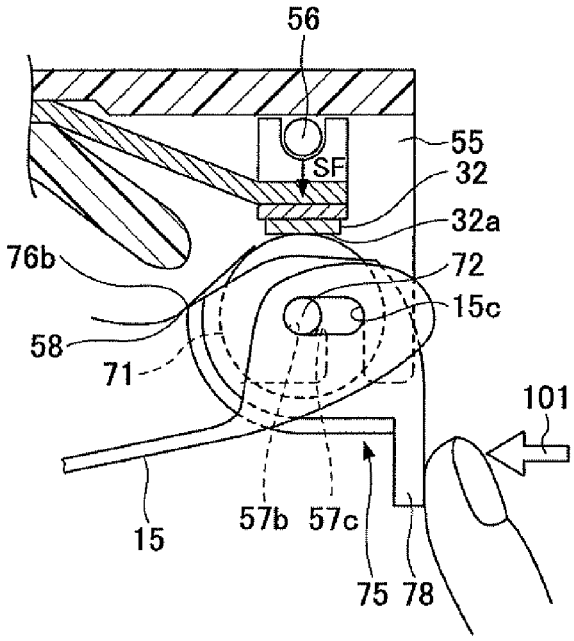
FIGS. 12A, 12B, 12C and 12D are cross sectional views for explaining unlocking of the platen roller shaft.
Figure 12B:
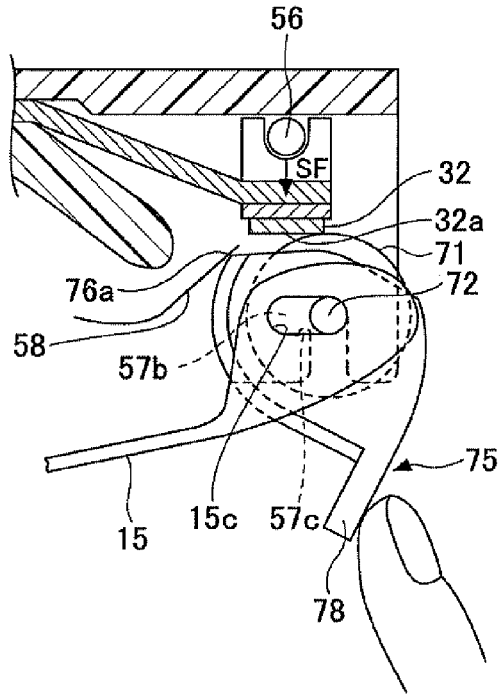
Figure 12B:
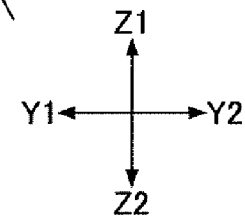
Figure 12C:
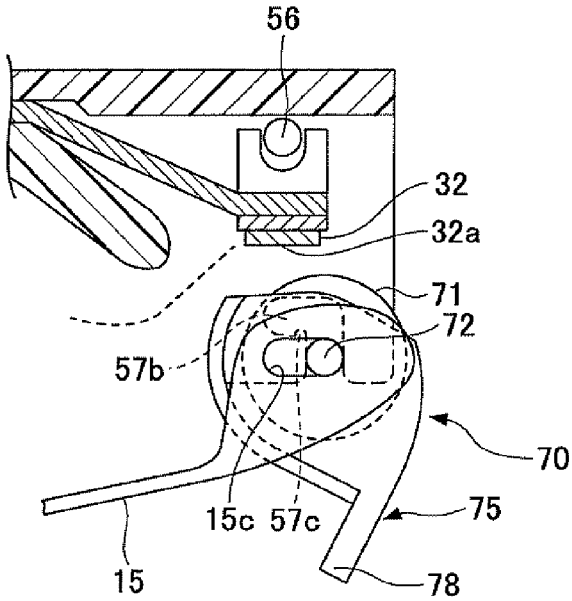
Figure 12D:
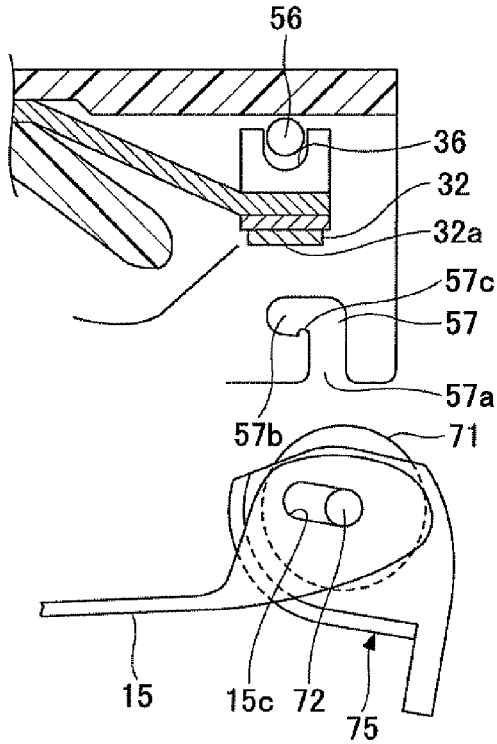

The lid 15 is opened by unlocking (or releasing the lock of) the platen roller shaft 72. When unlocking the platen roller shaft 72, the operation part 78 is pushed in the Y2 direction by the finger-tip of the operator as indicated by an arrow 101 in FIG. 12A, in order to turn the holder 75 clockwise as indicated in FIG. 12B. FIGS. 12A, 12B, 12C and 12D are cross sectional views for explaining unlocking of the platen roller shaft 72. In this state, the corner portion 76*b* of the holder 75 moves along the holder guide part 58 and the holder 75 moves in the Y2 direction. Hence, the platen roller shaft 72 rides over the convex part 57*c* and moves outside the shaft lock part 57*b*, to unlock the platen roller shaft 72. The platen roller shaft 72 moves towards the Y2 side of the elongated hole 15*b*.

When the platen roller shaft 72 is unlocked, the platen roller 71 is moved in the Z2 direction by the head spring force SF, to slightly turn the lid 15. Hence, when the operator performs the operation of opening the lid 15, the platen roller shaft 72 escapes from the locking cutout part 57.

Accordingly, the fabrication cost of the thermal printing apparatus 20 can be reduced because the above described mechanism for locking the platen roller shaft 72 does not use a hook member.

[Operation of the Thermal Printing Apparatus 20]

As illustrated in FIG. 2, a paper roll 90 is accommodated within the paper roll accommodating space 85 in a state where the lid 15 is open, and the heat sensitive paper 91 is drawn out from the paper roll 90. Then, the lid 15 is closed, and the platen roller shaft 72 is locked. The heat sensitive paper 91 is interposed between the platen roller 71 and the thermal head 32. Actually, this operation is performed in a state where the thermal printing apparatus 20 is facing upwards.

Figure 13:
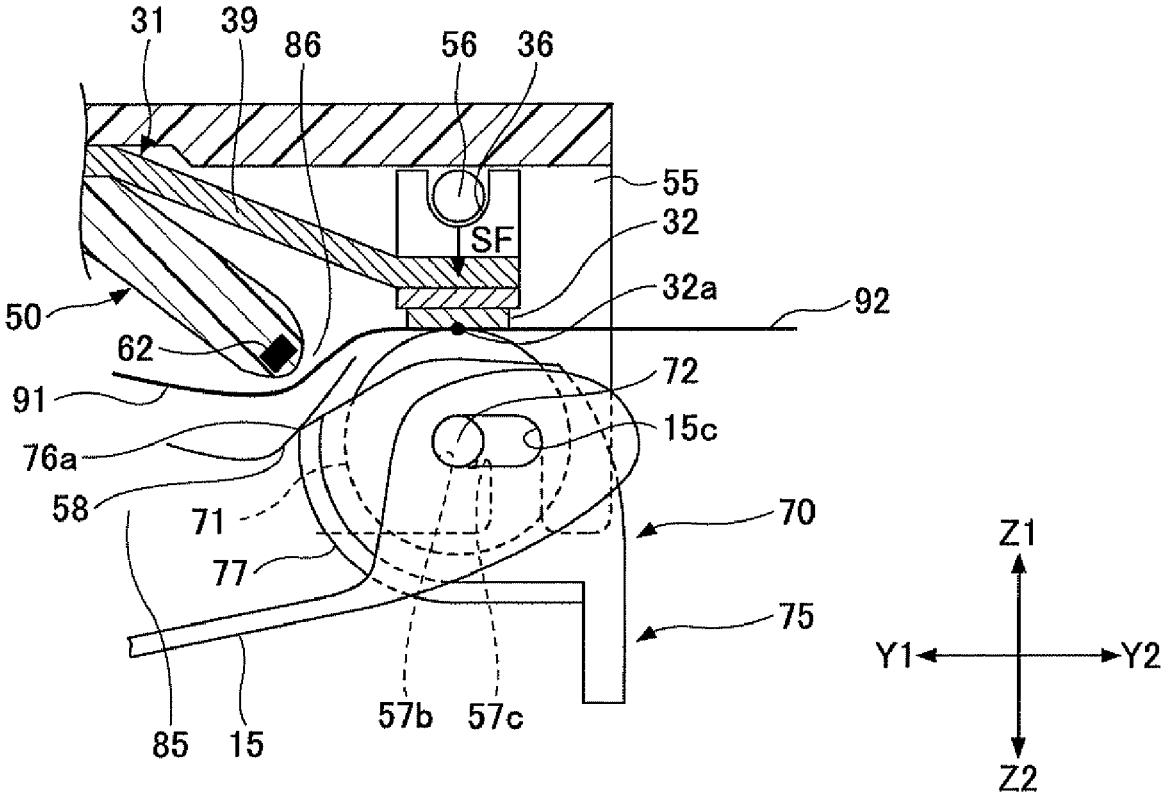
FIG. 13 is a cross sectional view illustrating a state where heat sensitive paper is interposed between the platen roller and the thermal head in the thermal printing apparatus.

In addition, as illustrated in FIG. 13, the platen roller 71 pushes the thermal head 32 and resiliently deforms the leaf spring arm 39 to generate the head spring force SF. FIG. 13 is a cross sectional view illustrating a state where heat sensitive paper 91 is interposed between the platen roller 71 and the thermal head 32 in the thermal printing apparatus 20. Hence, the platen roller 71 pushes against the thermal head 32. Further, the gear 73 enters within the gear accommodating box part 53 and meshes with the gear 65.

After the above described operation, the thermal printing apparatus 20 assumes a ready state ready to perform an operation.

The thermal head 32 is driven and the heater part 32*a* is heated in response to a print instruction. In addition, the pulse motor 68 is driven to rotate the platen roller 71 via the reduction gear mechanism 67. As a result, the thermal head 32 prints data on the heat sensitive paper 92 in response to a data signal, and the printed heat sensitive paper 91 is ejected in the Y2 direction. The heat sensitive paper 91 is guided by the paper guide surface 60 and moves within a paper passage 86, within the thermal printing apparatus 20.

When the heat sensitive paper 91 is almost used up and the diameter and weight of the paper roll 90 become small, the paper roll 90 is pulled by the heat sensitive paper 91 and moves in the Y2 direction. However, the paper roll 90 having the small diameter is received by the paper jam preventing part 77, and the paper roll 90 is prevented from jamming into the entrance of the paper passage 86. If the paper roll 90 having the small diameter jams into the entrance of the paper passage 86, it would become impossible to feed the heat sensitive paper 91 from the paper roll 90 and perform the printing on the heat sensitive paper 91 in a normal manner. But according to this embodiment, it is possible to positively feed the heat sensitive paper 91 from the paper roll 90 even when the diameter of the paper roll 90 becomes small, and the printing on the heat sensitive paper 91 can be performed in a normal manner until the heat sensitive paper 91 of the paper roll 90 runs out. Furthermore, the photosensor 62 detects a state where the diameter of the paper roll 90 has become small, that is, has become less than a predetermined value.

[Modification of the Holder 75]

Figures 14A, 14B:
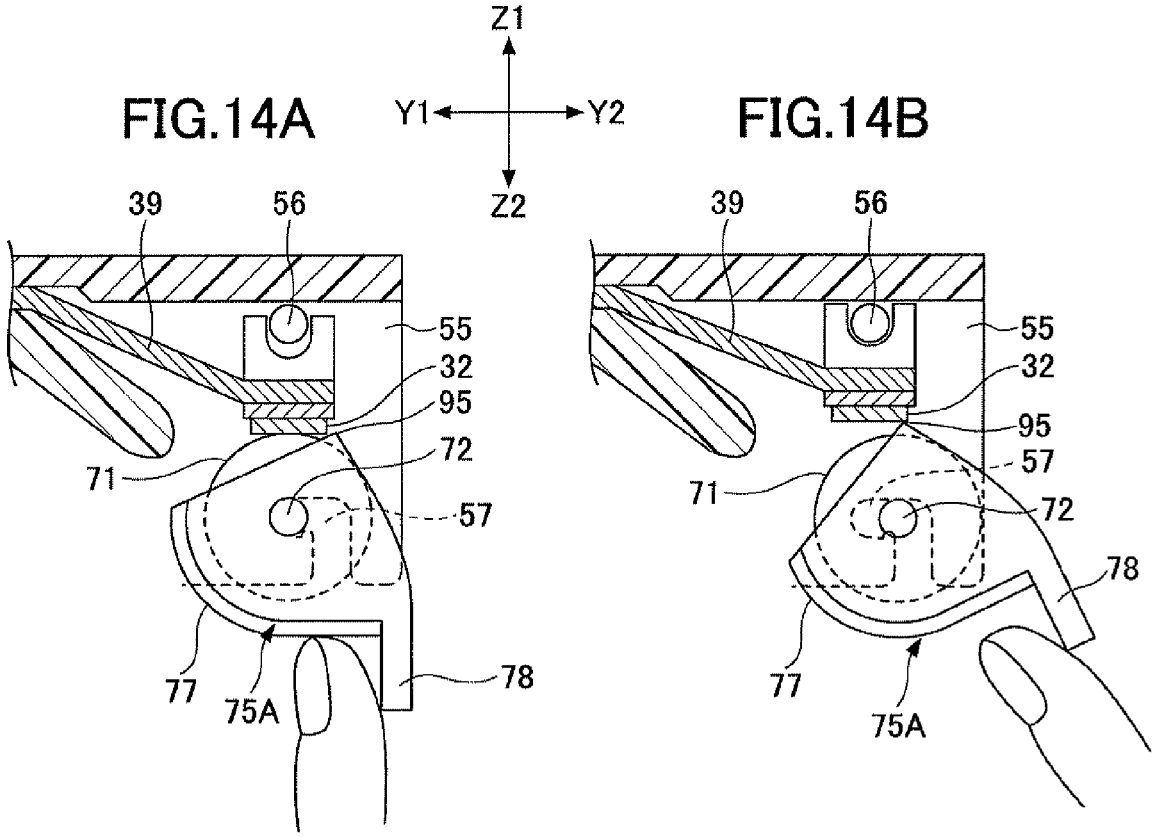
FIGS. 14A and 14B are cross sectional views illustrating a modification of a holder.

FIGS. 14A and 14B are cross sectional views illustrating a modification of the holder 75. A holder 75A of this modification has a thermal head up-guide part 95. In a state where the lid 15 is closed and the platen roller shaft 72 is locked, the thermal head up-guide part 95 is adjacent to and opposes the head mounting part 35 of the leaf spring member 34.

When the operation part 78 is pushed counterclockwise or in the Y2 direction by the finger-tip of the operator as illustrated in FIG. 14B to turn the holder 75A, the leaf spring member 34 is bent in the Z1 direction and the thermal head 32 is displaced in the Z1 direction. Consequently, the platen roller shaft 72 rides over the convex part 57*c* and escapes outside the shaft lock part 57*b*, to thereby unlock the platen roller shaft 72.

Second Embodiment

Figure 15:
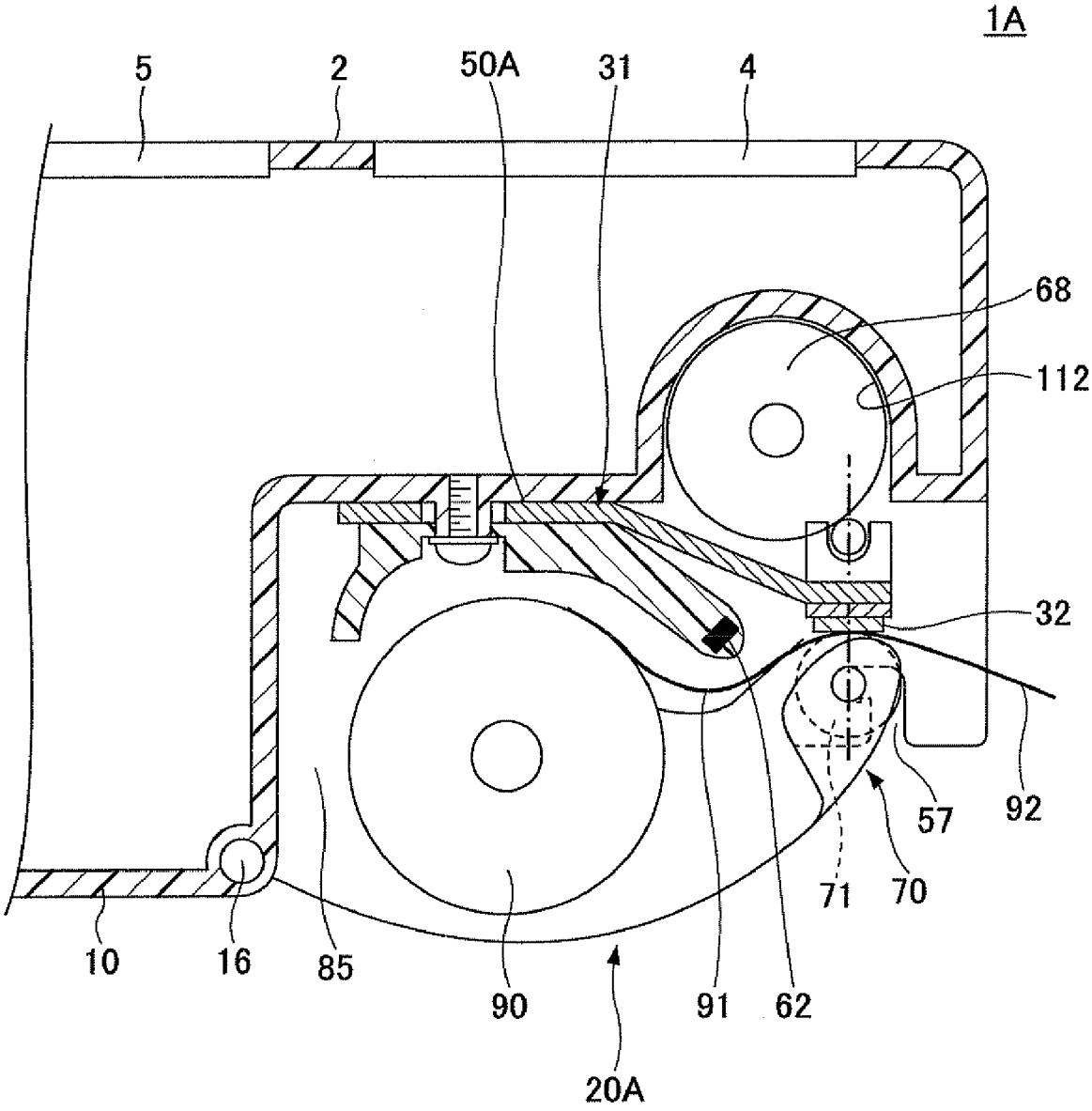
FIG. 15 is a cross sectional view illustrating a part of the thermal printing apparatus applied with the thermal printer module in a second embodiment of the present invention.

FIG. 15 is a cross sectional view illustrating a part of a thermal printing apparatus 20A of a credit card settlement apparatus 1A applied with a thermal printer module 30A in a second embodiment of the present invention. The arrangement of the pulse motor 68 in the thermal printing apparatus 20A is different from that of the thermal printing apparatus 20 illustrated in FIG. 2. In the thermal printing apparatus 20A, the pulse motor 68 is arranged inside the credit card settlement apparatus 1A.

Figure 16:
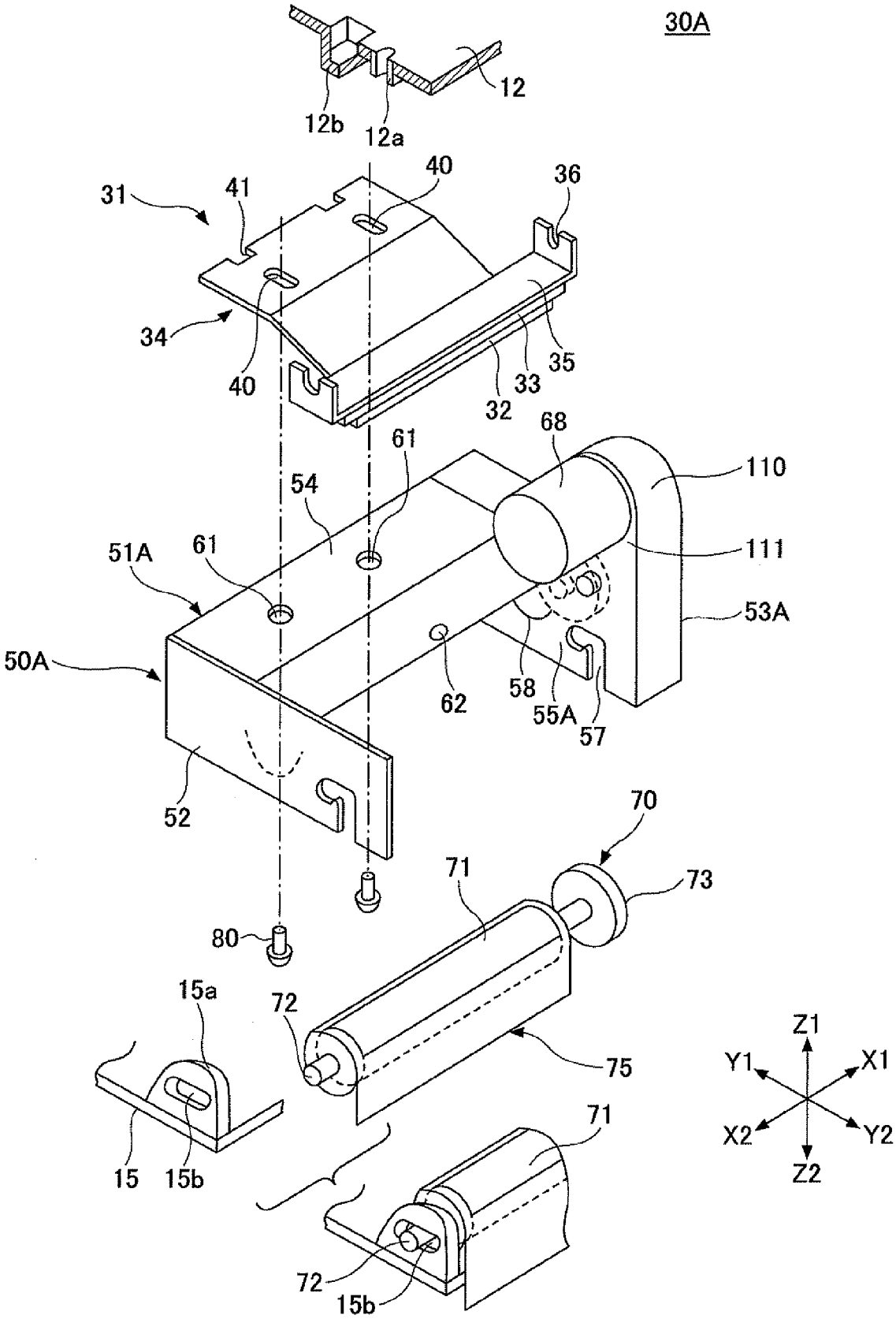
FIG. 16 is a disassembled perspective view of the thermal printer module in the second embodiment of the present invention.

FIG. 16 is a disassembled perspective view of the thermal printer module 30A. The thermal printer module 30A includes the thermal head assembly 31, a main assembly 50A, and the platen roller assembly 70. The main assembly 50A has a structure different from that of the main assembly 50 illustrated in FIG. 4.

The main assembly 50A has a frame 51A including a box part 53A. The box part 53A has an extension part 110 which extends in the Z1 direction. A side plate part 55A also has an extension part 111 extending in the Z1 direction. The extension part 111 is formed on the side plate part 55A at a position on the Z1 side of the locking cutout part 57, that is, at a position corresponding to the locking cutout part 57.

The pulse motor 68 is mounted on the extension part 111 at a position on the Z1 side than the paper guide part 54, that is, at a position corresponding to the locking cutout part 57 and on the opposite side from the paper roll accommodating space 85 with respect to the paper guide part 54.

The credit car settlement apparatus 1A has a concave part 112 with a depth in the Z1 direction in a portion of the plate part 12 at the bottom portion of the recess 11 of the housing 10, as illustrated in FIG. 15. The main assembly 50A and the thermal head assembly 31 are fixed on the plate part 12 by screws, and the pulse motor 68 of the main assembly 50A is accommodated within the concave part 112. The paper roll accommodating space 85 of the thermal printing apparatus 20A is larger than that of the first embodiment and prevents the pulse motor 68 from projecting into the paper roll accommodating space 85. For this reason, the paper roll 90 with a relatively large diameter may be accommodated within the paper roll accommodating space 85.

Third Embodiment

Figure 17:
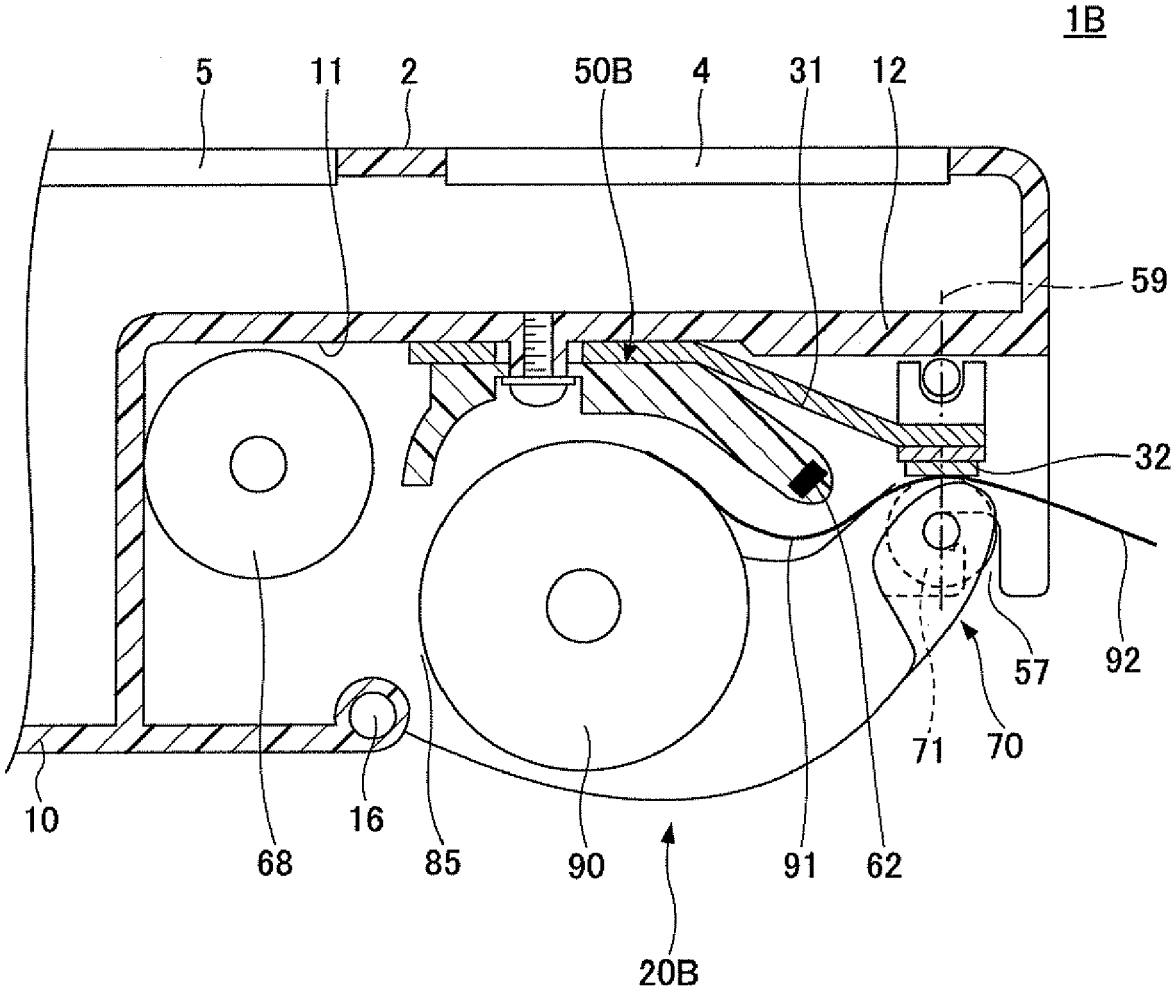
FIG. 17 is a cross sectional view illustrating a part of the thermal printing apparatus applied with the thermal printer module in a third embodiment of the present invention.

FIG. 17 is a cross sectional view illustrating a part of a thermal printing apparatus 20B of a credit card settlement apparatus 1B applied with a thermal printer module 30B in a third embodiment of the present invention. The arrangement of the pulse motor 68 in the thermal printing apparatus 20B is different from that of the thermal printing apparatus 20 illustrated in FIG. 2.

Figure 18:
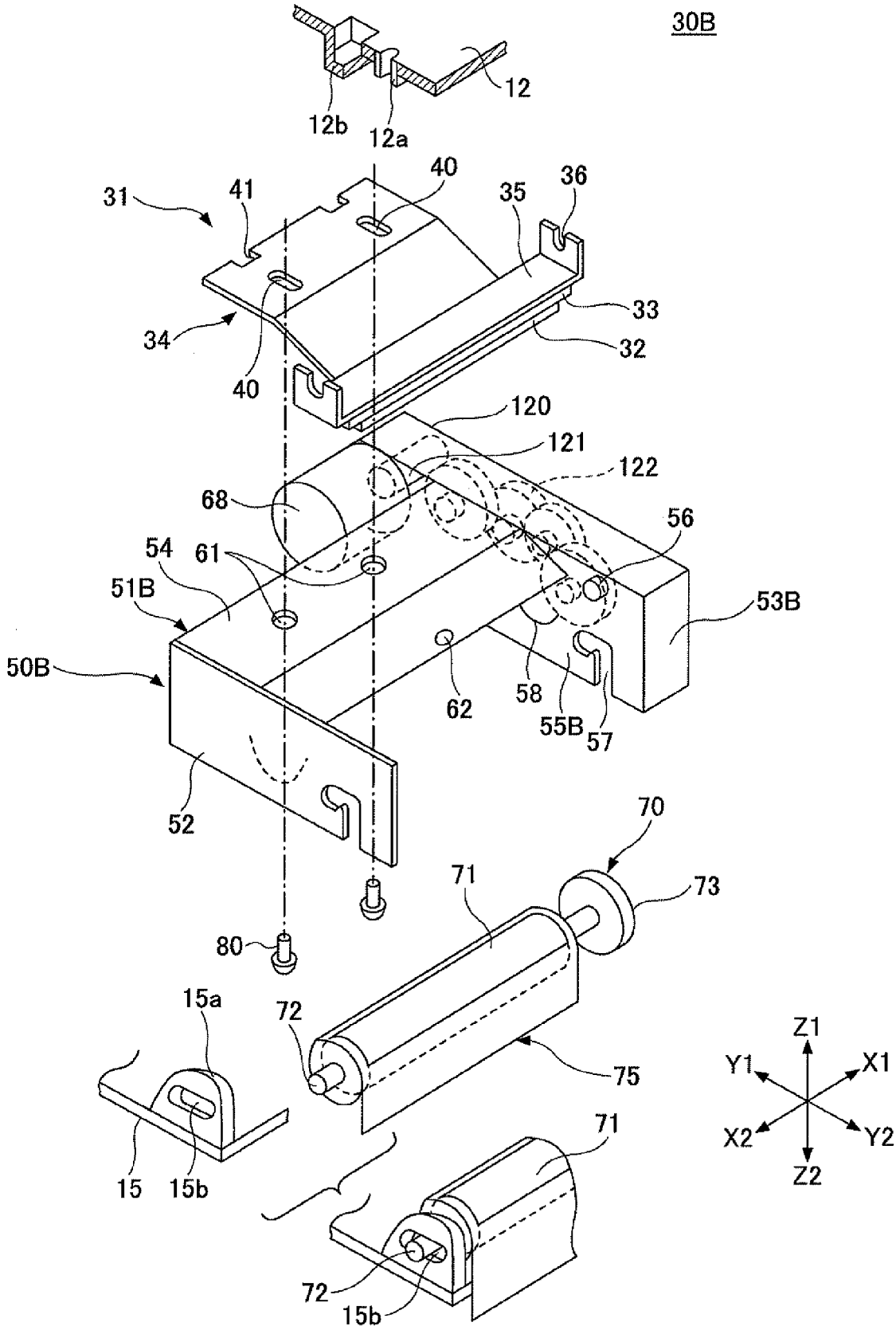
FIG. 18 is a disassembled perspective view of the thermal printer module in the third embodiment of the present invention.

FIG. 18 is a disassembled perspective view of the thermal printer module 30B. The thermal printer module 30B includes the thermal head assembly 31, a main assembly 50B, and the platen roller assembly 70. The main assembly 50B has a structure different from that of the main assembly 50 illustrated in FIG. 4.

The main assembly 50B has a frame 51B including a box part 538. The box part 53B has an extension part 120 which extends in the Y1 direction. A side plate part 558 also has an extension part 121 extending in the Y1 direction.

The pulse motor 68 is mounted on the extension part 121 at a position which is on the Y1 side than the paper guide part 54 and on the Y1 than the paper roll accommodating space 85.

A reduction hear mechanism 122 for reducing the rotation and transmitting the rotation of the pulse motor 68 to the gear 65 is provided within the box part 53B. Of course, a belt mechanism may be provided in place of the reduction gear mechanism 122.

The thermal printing apparatus 20B may be made to have a flat structure. In addition, the paper roll accommodating space 85 of the thermal printing apparatus 20B is larger than that of the first embodiment and prevents the pulse motor 68 from projecting into the paper roll accommodating space 85. For this reason, the paper roll 90 with a relatively large diameter may be accommodated within the paper roll accommodating space 85.

Fourth Embodiment

Figure 19:
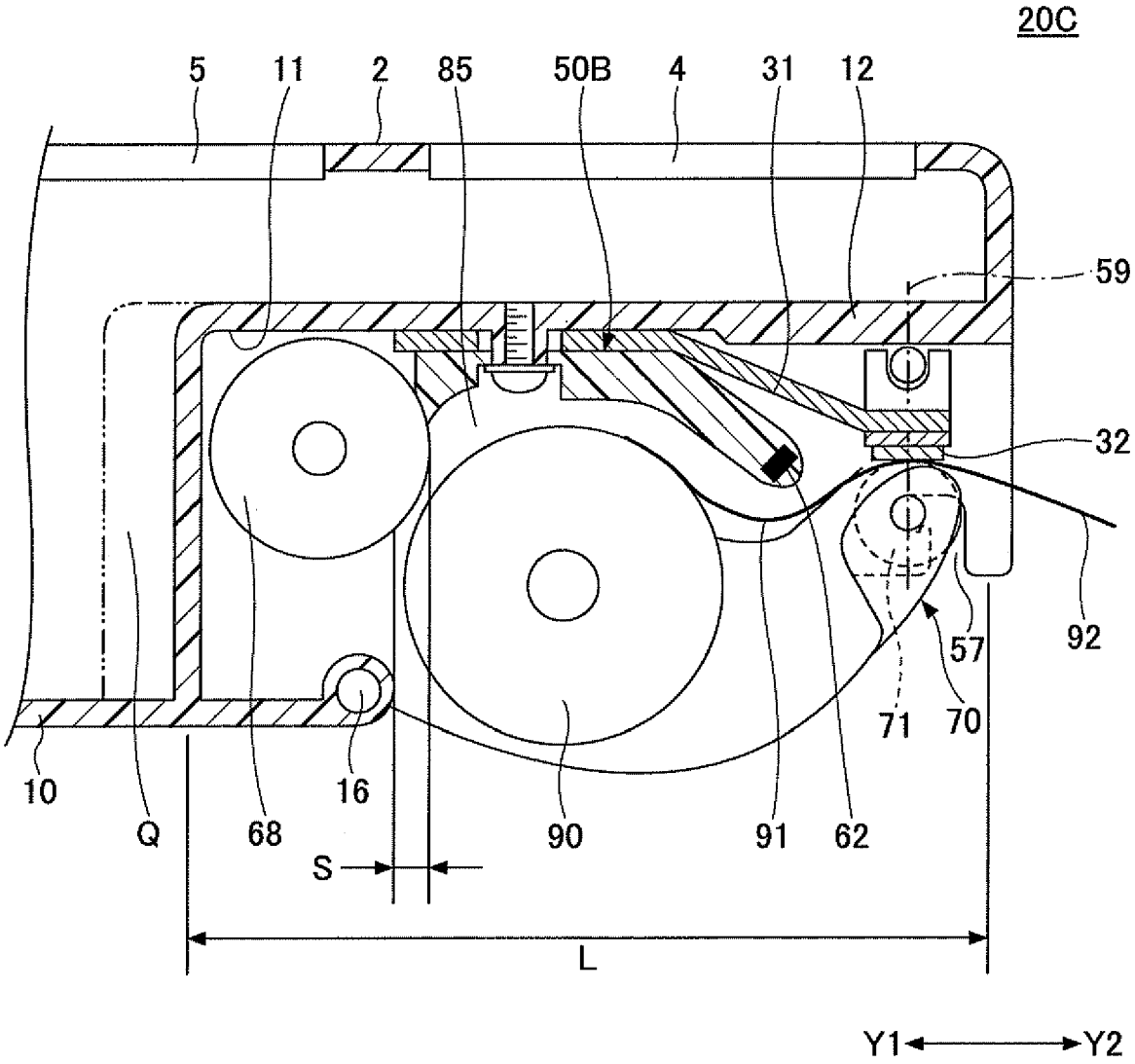
FIG. 19 is a cross sectional view illustrating a part of the thermal printing apparatus applied with the thermal printer module in a fourth embodiment of the present invention.

FIG. 19 is a cross sectional view illustrating a part of a thermal printing apparatus 200 applied with a thermal printer module 30C in a fourth embodiment of the present invention. The arrangement of the pulse motor 68 in the thermal printing apparatus 20C is different from that of the thermal printing apparatus 20 illustrated in FIG. 2. The pulse motor 68 projects into the paper roll accommodating space 85 by a distance S in the Y2 direction.

Accordingly, the length of the thermal printing apparatus 20C in the Y1-Y2 direction is L, and is shorter than the length of the thermal printing apparatus 20B illustrated in FIG. 17 by an amount corresponding to a space Q illustrated in FIG. 19.

Figure 20:
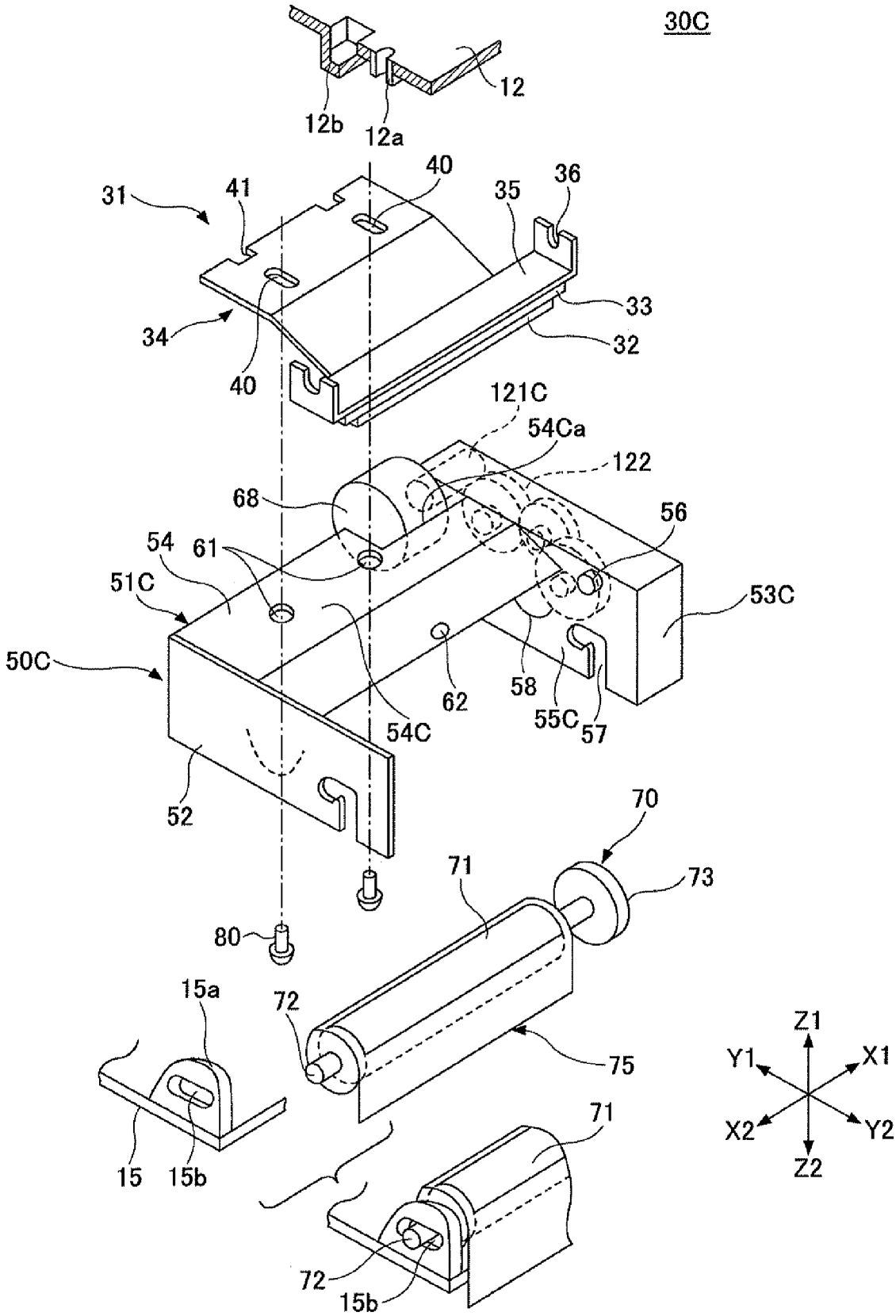
FIG. 20 is a disassembled perspective view of the thermal printer module in the fourth embodiment of the present invention.

FIG. 20 is a disassembled perspective view of the thermal printer module 30C. A paper guide part 54C of a frame 51C of a main assembly 50C has a cutout 54Ca. The pulse motor 68 is mounted in an extension part 121C in a state where a part of the pulse motor 68 fits into the cutout 54Ca.

Fifth Embodiment

Figure 21:
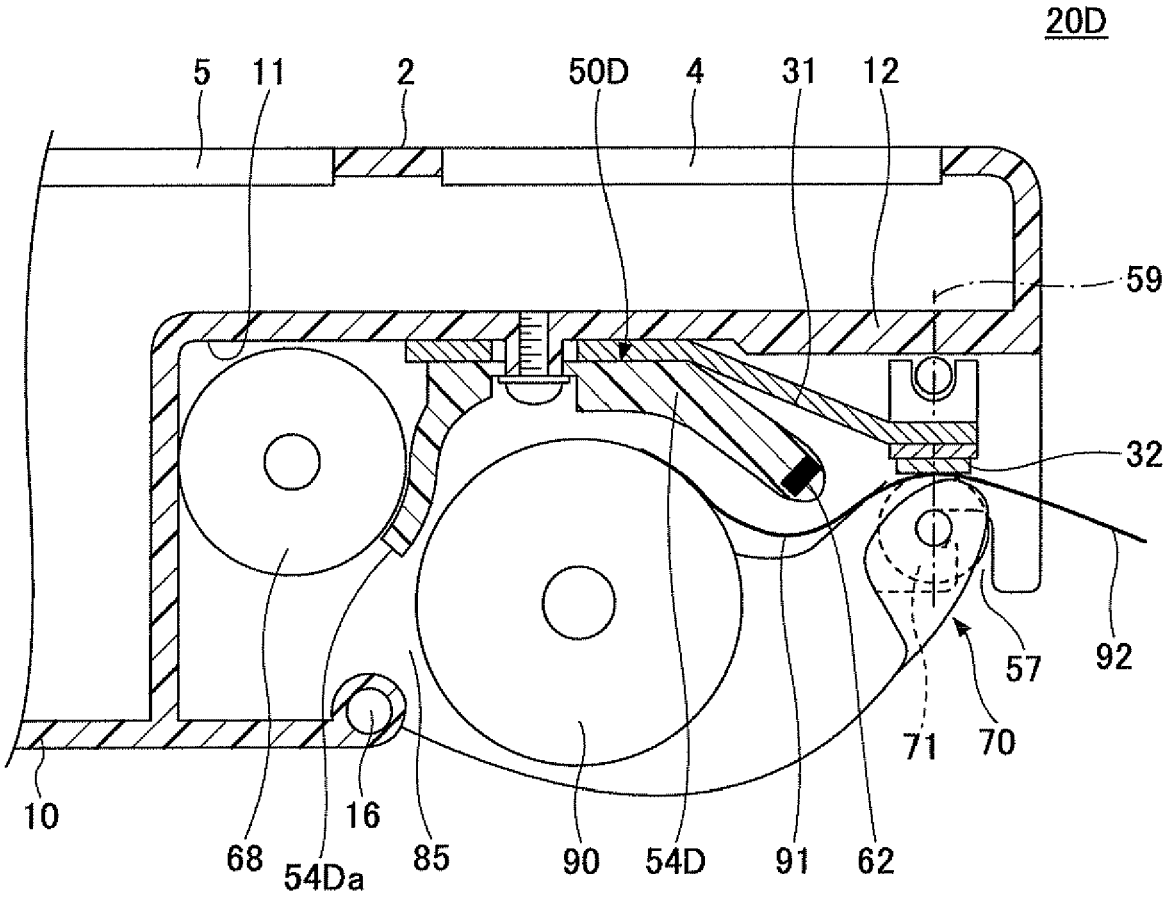
FIG. 21 is a cross sectional view illustrating a part of the thermal printing apparatus applied with the thermal printer module in a fifth embodiment of the present invention.

FIG. 21 is a cross sectional view illustrating a part of a thermal printing apparatus 20D applied with a thermal printer module 30D in a fifth embodiment of the present invention. A paper guide part 54D of the thermal printing apparatus 20D is different from that of the thermal printing apparatus 20B illustrated in FIG. 17.

The pulse motor 68 is covered by a motor cover 54Da of the paper guide part 54D, and the pulse motor 68 and the paper roll accommodating space 85 are partitioned from each other. Hence, the paper roll 90 and the pulse motor 68 are prevented from interfering with each other.

Figure 22:
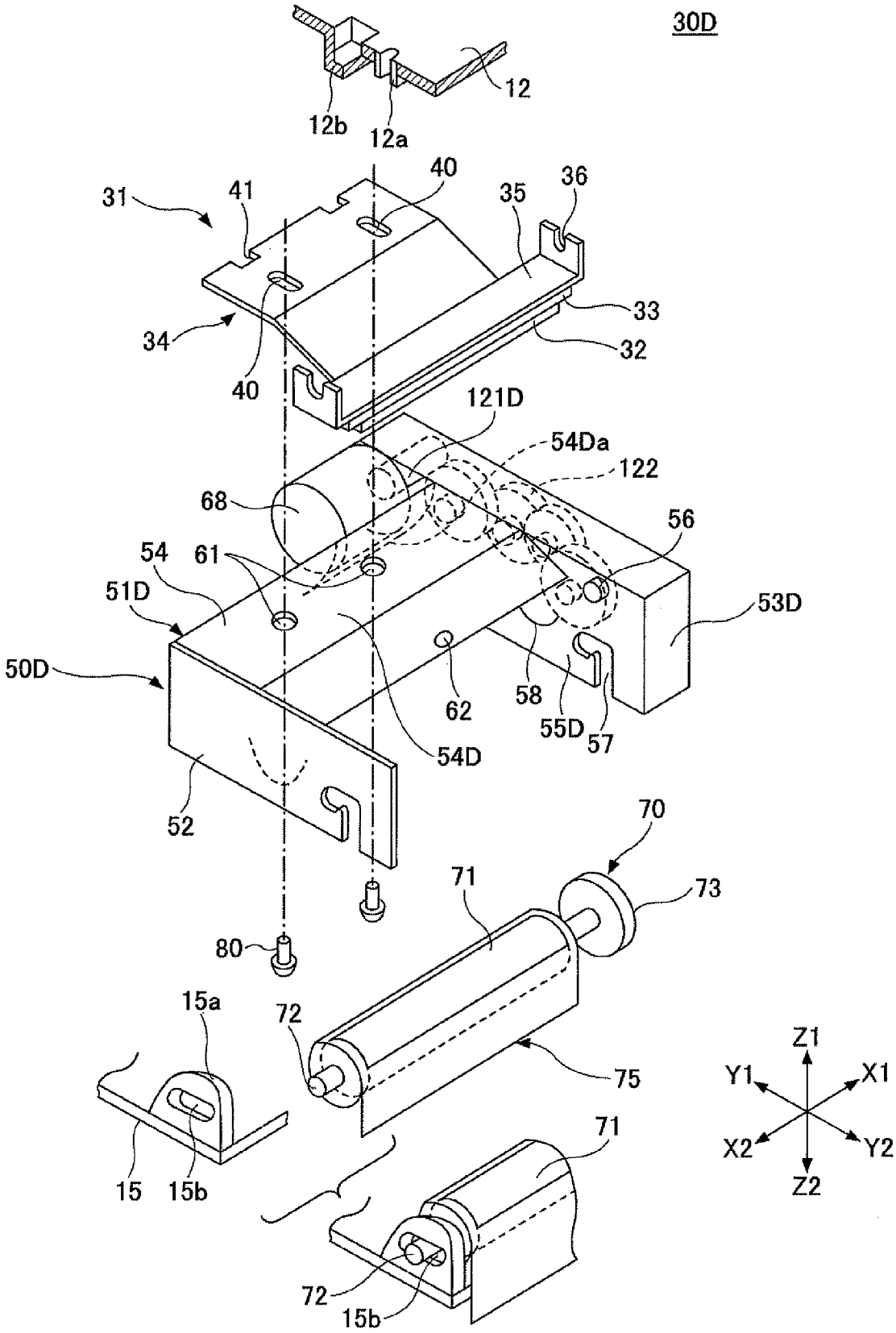
FIG. 22 is a disassembled perspective view of the thermal printer module in the fifth embodiment of the present invention.

FIG. 22 is a disassembled perspective view of the thermal printer module 30D. The paper guide part 54D of a frame 51D of a main assembly 50D includes the motor cover 54Da. The pulse motor 68 is mounted on the extension part 1210 in a state where a part of the pulse motor 68 is covered by the motor cover 54Da.

Sixth Embodiment

Figure 23:
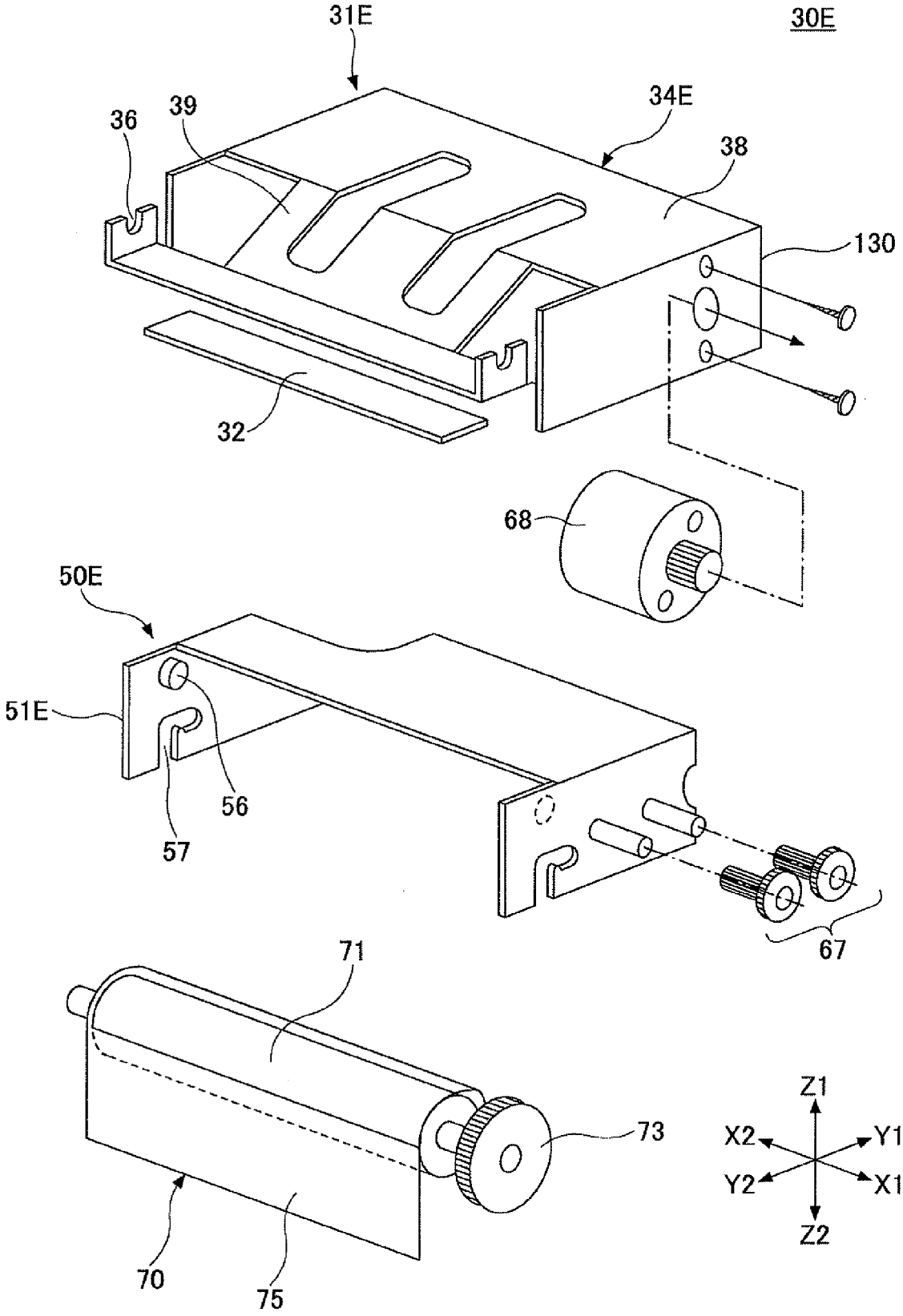
FIG. 23 is a disassembled perspective view of the thermal printer module in a sixth embodiment of the present invention.

FIG. 23 is a disassembled perspective view of a thermal printer module 30E in a sixth embodiment of the present invention. The thermal printer module 30E includes a thermal head assembly 31E, a main assembly 50E, and the platen roller assembly 70.

The thermal head assembly 31E has a leaf spring member 34E including a flange part 130 that is formed by being the plate-shaped base 38 at both ends on the X1 side and the X2 side in the Z2 direction. The pulse motor 68 is mounted on the flange part 130 provided on the X1 side of the plate-shaped base 38. The main assembly 50E has the reduction gear mechanism 67 mounted on a frame 51E.

A thermal printing apparatus is applied with the thermal printer module 30E, similarly as in the case of the thermal printing apparatus 20 illustrated in FIG. 2, to form a credit card settlement apparatus. The plate-shaped base 38 of the thermal head assembly 31E is mounted on the credit card settlement apparatus.

Seventh Embodiment

Figure 24:
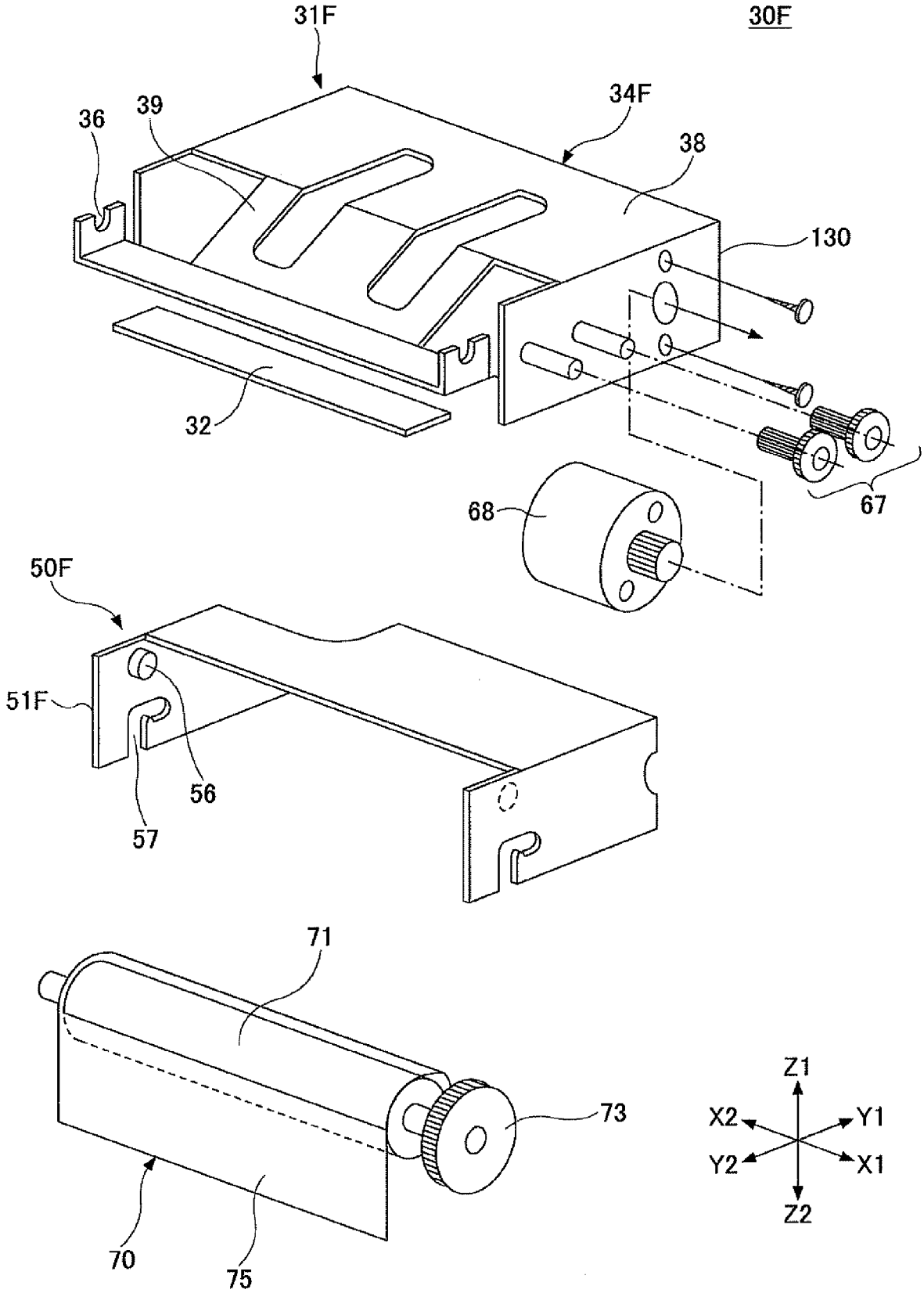
FIG. 24 is a disassembled perspective view of the thermal printer module in a seventh embodiment of the present invention.

FIG. 24 is a disassembled perspective view of a thermal printer module 30F in a seventh embodiment of the present invention. A thermal head assembly 31D and a main assembly 50F of the thermal printer module 30F differ from those of the thermal head assembly 31E described above.

In the thermal head assembly 31F, the pulse motor 68 and the reduction gear mechanism 67 are mounted on the flange part 130 of a leaf spring member 34F. That is, in the main assembly 50F, the reduction gear mechanism is not mounted on a frame 51F.

Eighth Embodiment

Figure 25:
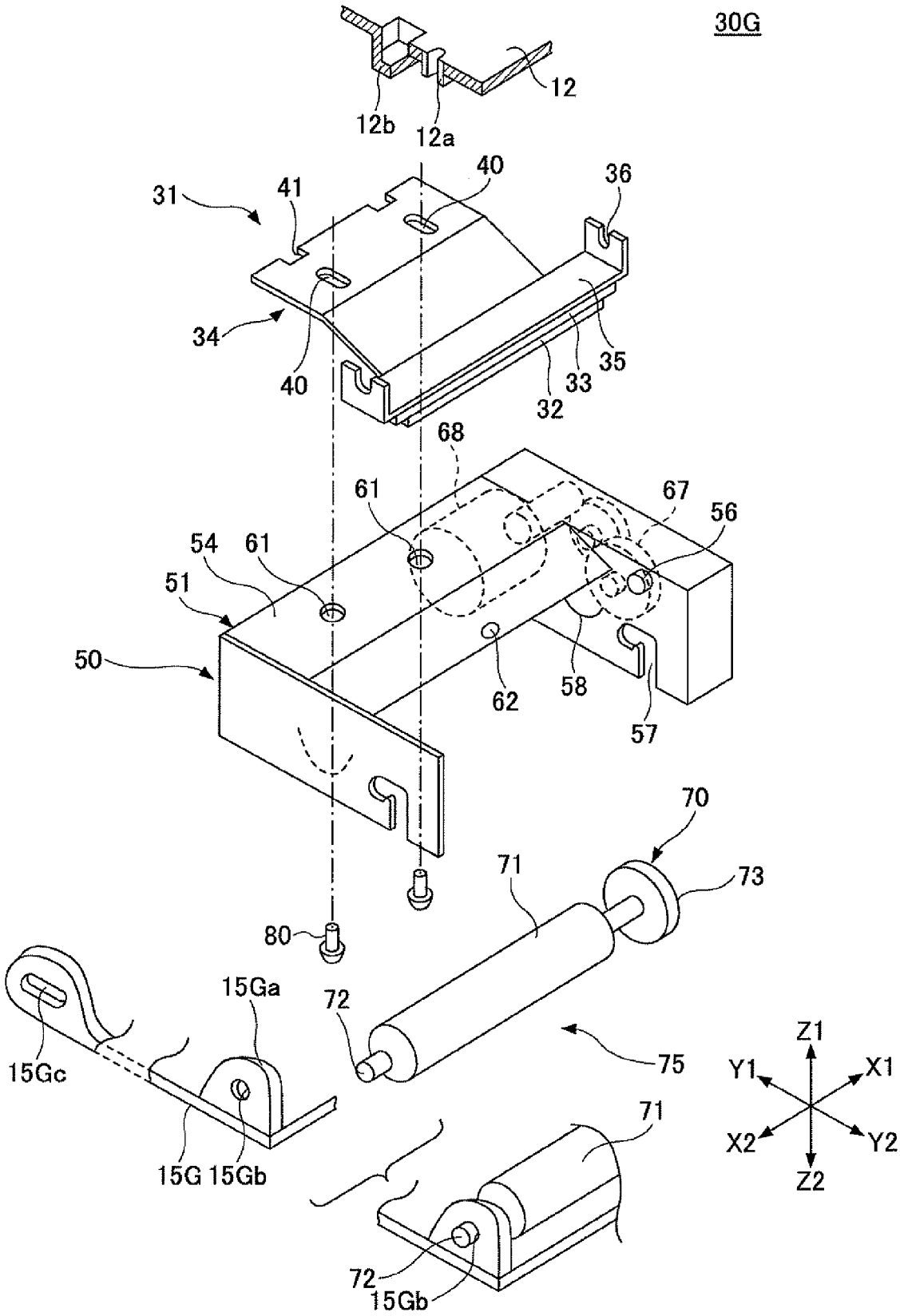
FIG. 25 is a disassembled perspective view of the thermal printer module in an eighth embodiment of the present invention.

FIG. 25 is a disassembled perspective view of a thermal printer module 30G in an eighth embodiment of the present invention. The thermal printer module 30G includes the thermal head assembly 31, the main assembly 50, and the platen roller 71. The thermal printer module 30G differs from the thermal printer module 30 illustrated in FIG. 3, in that the thermal printer module 30G includes the platen roller 71 in place of the platen roller assembly 70.

Figure 26A:
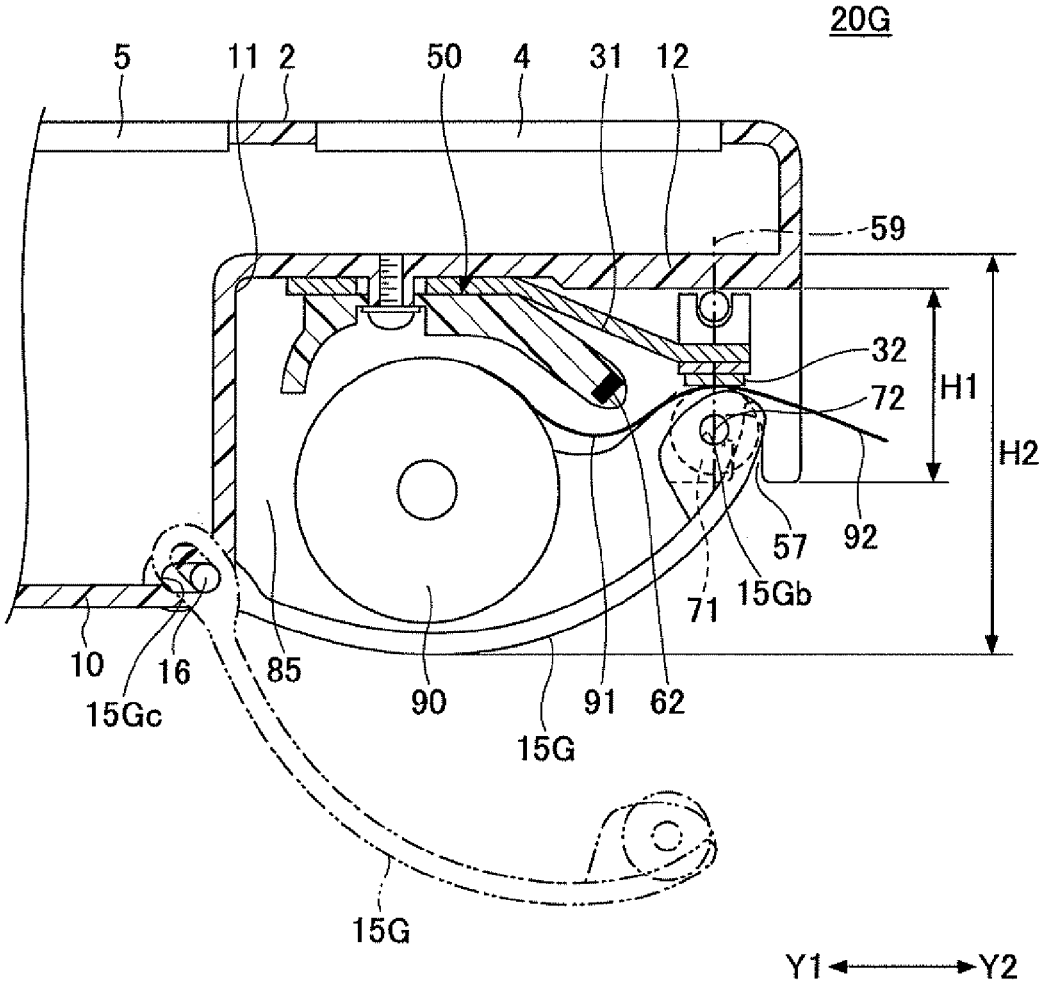
FIGS. 26A and 26B are cross sectional views illustrating a part of the thermal printing apparatus applied with the thermal printer module of FIG. 25.
Figure 26B:
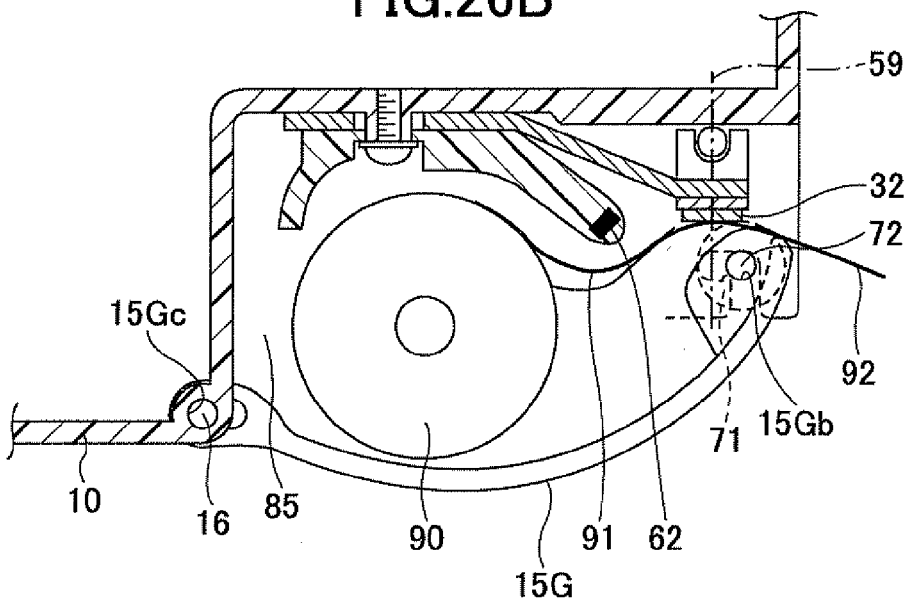

FIGS. 26A and 26B are cross sectional views illustrating a part of a thermal printing apparatus 20G applied with the thermal printer module 30G of FIG. 25. A lid 15G of the thermal printing apparatus 20G differs from the lid 15 of the thermal printing apparatus 20 illustrated in FIG. 2.

As illustrated in FIG. 26A, a flange part 15Ga on both sides at the tip end of the lid 15G includes a circular hole 15Gb, and the base end of the lid 15G includes an elongated hole 15Gc. The platen roller shaft 72 of the platen roller 71 is supported by the flange part 15Ga at holes 15Gb in the flange part 15Ga. The shaft 16 of the lid 15G is supported by the base end at the elongated hole 15Gc in the base end of the lid 15G, and the lid 15G is movable in the longitudinal direction of the elongated hole 15Gc within the range of the elongated hole 15Gc.

The operator turns and closes the lid 15G in a state where the shaft 16 is on the Y2 side within the elongated hole 15Gc. After the platen roller shaft 72 enters within the locking cutout part 57, the operator moves the lid 15G in the Y1 direction. As a result, the platen roller shaft 72 is engaged and locked by the shaft lock part 57*b*, and the shaft 16 moves in the Y1 direction within the elongated hole 15Gc.

When opening the lid 15G, the operator performs an operation in reverse to the above described operation performed when closing the lid 15G. In other words, the operator once moves the lid 15G in the Y2 direction, so that the platen roller shaft 72 escapes from the shaft lock part 57*b* as illustrated in FIG. 16B, and then turns the lid 15G clockwise. As a result, the platen roller shaft 72 is unlocked to allow opening of the lid 15F.

Ninth Embodiment

Figure 27:
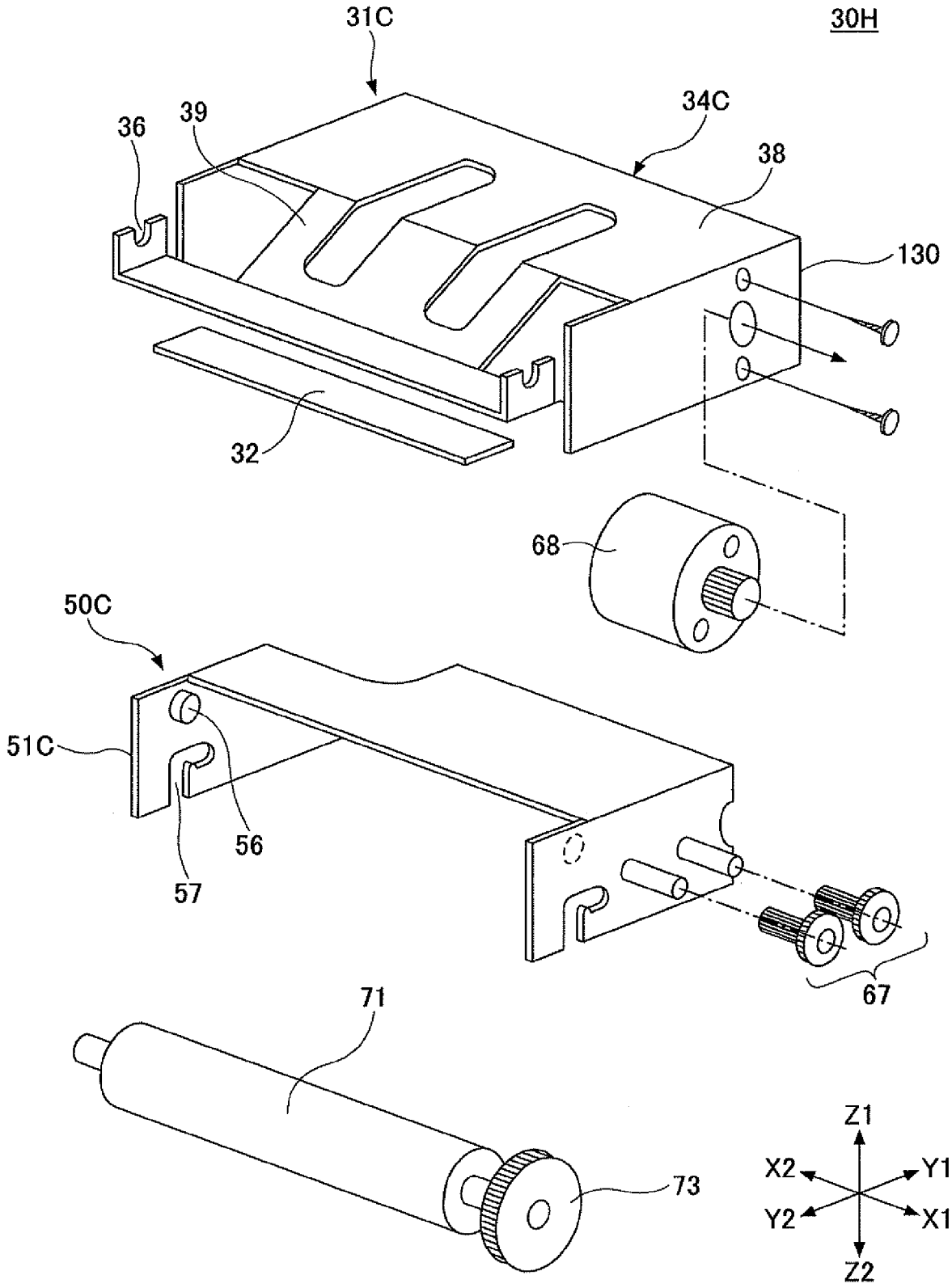
FIG. 27 is a disassembled perspective view of the thermal printer module in a ninth embodiment of the present invention.

FIG. 27 is a disassembled perspective view of a thermal printer module 30H in a ninth embodiment of the present invention. The thermal printer module 30H includes the thermal head assembly 31E, the main assembly 50E, and the platen roller 71. The thermal printer module 30H differs from the thermal printer module 30E illustrated in FIG. 23 in that the platen roller 71 is provided in plate of the platen roller assembly 70.

When a thermal printing apparatus is applied with the thermal printer module 30H, the lid needs to be slightly movable in the Y1-Y2 direction, as in the case of the structure illustrated in FIGS. 26A and 26B.

Tenth Embodiment

Figure 28:
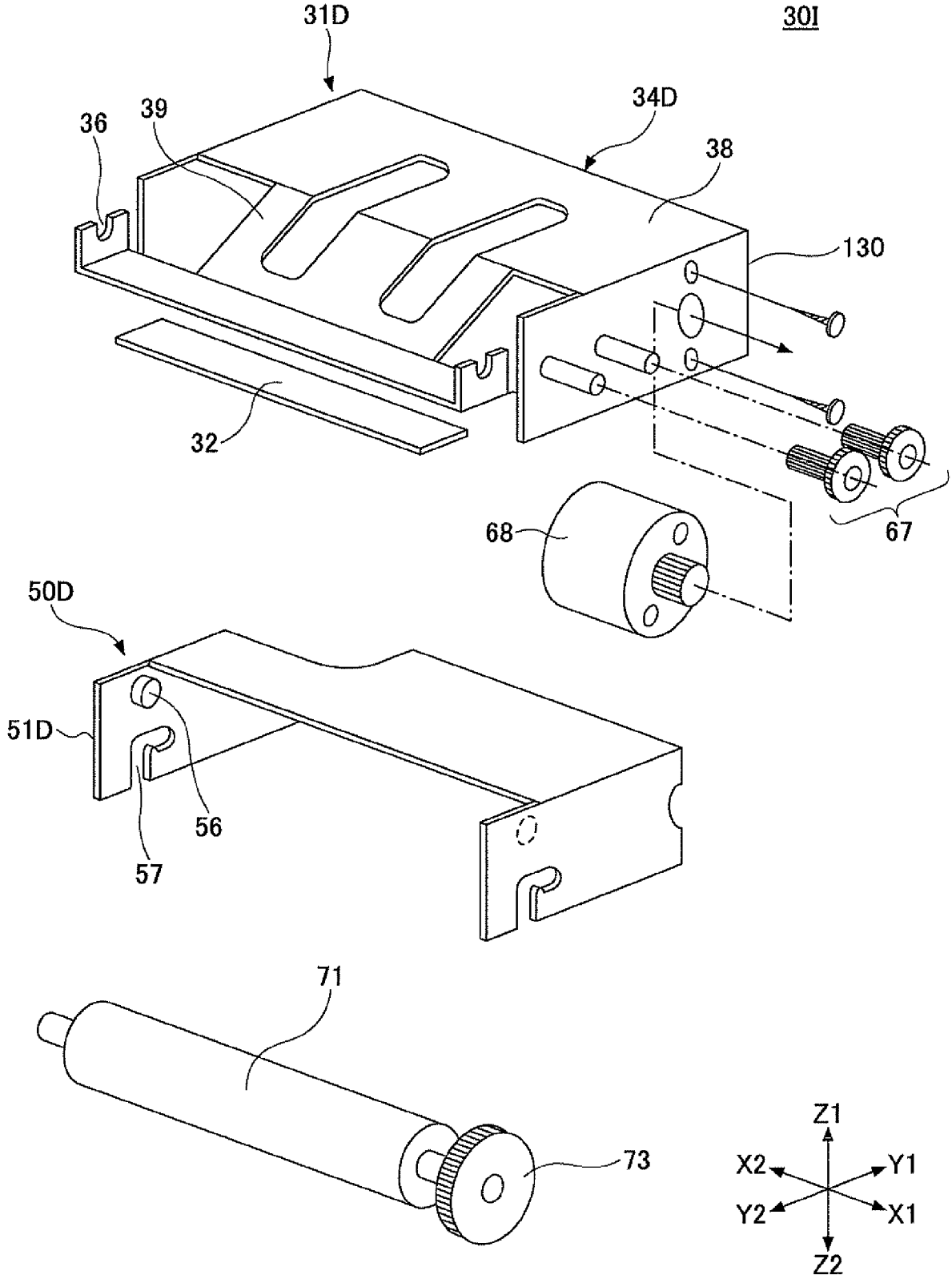
FIG. 28 is a disassembled perspective view of the thermal printer module in a tenth embodiment of the present invention.

FIG. 28 is a disassembled perspective view of a thermal printer module 30I in a tenth embodiment of the present invention. The thermal printer module 30I includes the thermal head assembly 31E, the main assembly 50E, and the platen roller 71. The thermal printer module 30I differs from the thermal printer module 305 illustrated in FIG. 23 in that the platen roller 71 is provided in plate of the platen roller assembly 70.

When a thermal printing apparatus is applied with the thermal printer module 30I, the lid needs to be slightly movable in the Y1-Y2 direction, as in the case of the structure illustrated in FIGS. 26A and 26B.

[Modifications of the Thermal Head Assembly]

Next, a description will be given of modifications of the thermal head assembly.

Figure 29A:
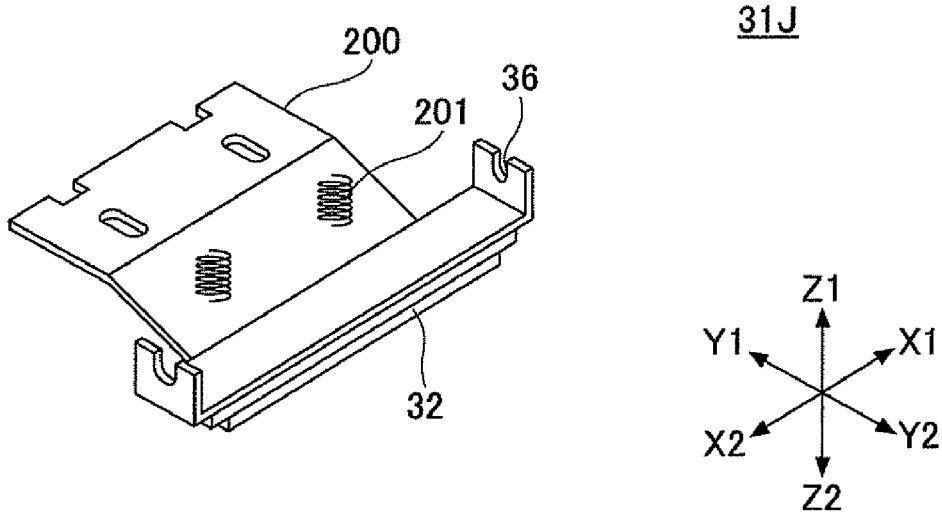
FIGS. 29A and 29B are a perspective view and a cross sectional view illustrating a first modification of the thermal head assembly.
Figure 29B:
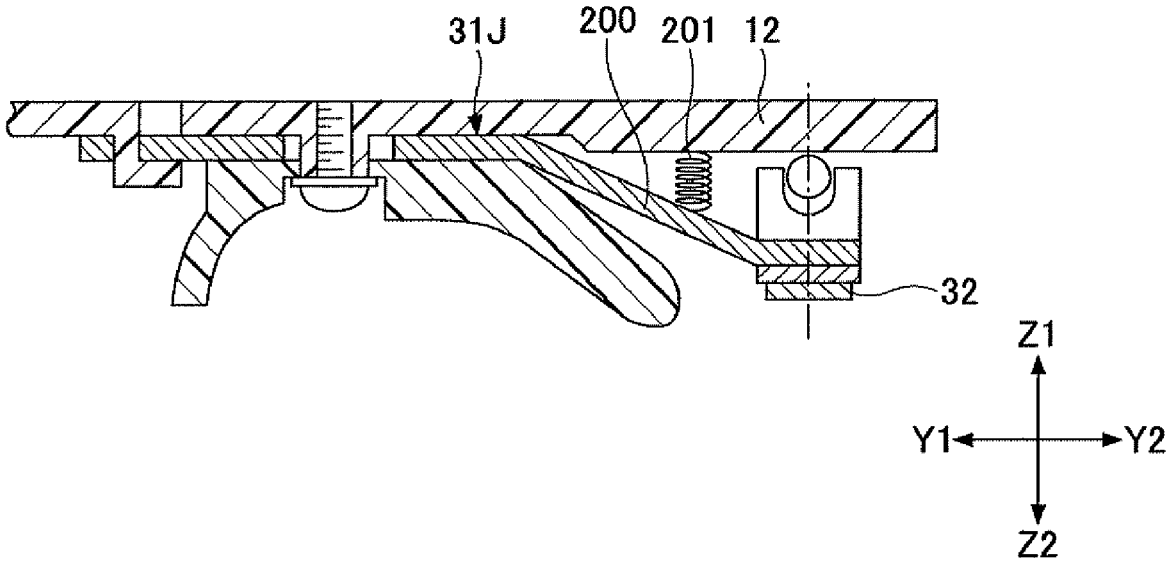

FIGS. 29A and 29B are a perspective view and a cross sectional view illustrating a first modification of the thermal head assembly. A thermal head assembly 31J uses a flexible plate member 200 which is made of a metal or a synthetic resin, in place of the leaf spring member 34 of the thermal head assembly 31 illustrated in FIG. 5. A pair of compression coil springs 201 for applying head pressure are mounted side-by-side on the plate member 200.

As illustrated in FIG. 29B, the thermal head assembly 31J is mounted on the plate part 12 of the housing, and the compression coil springs 201 are interposed between the plate member 200 and the plate part 12. When a platen roller pushes against the thermal head 32 and the plate member 200 is deformed, the compression coil springs 201 are compressed to apply the head pressure.

Figure 30A:
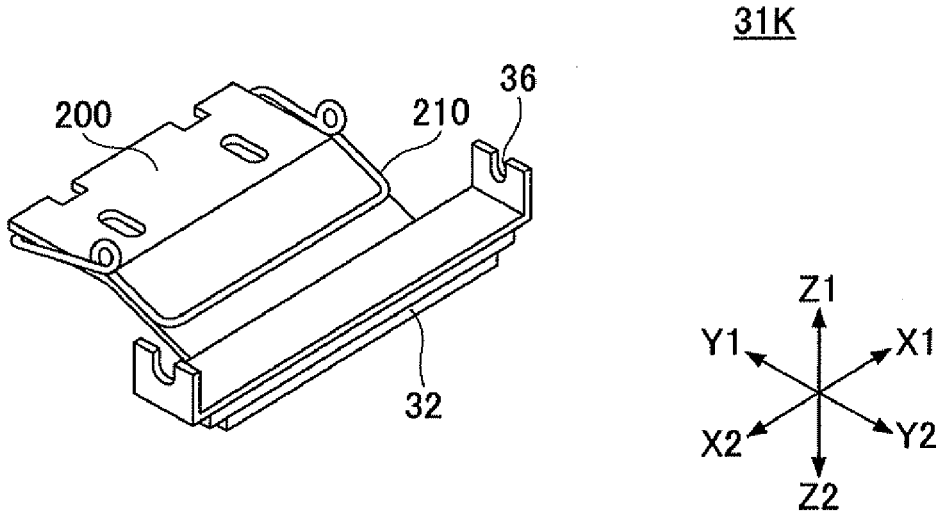
FIGS. 30A and 30B are a perspective view and a cross sectional view illustrating a second modification of the thermal head assembly.
Figure 30B:
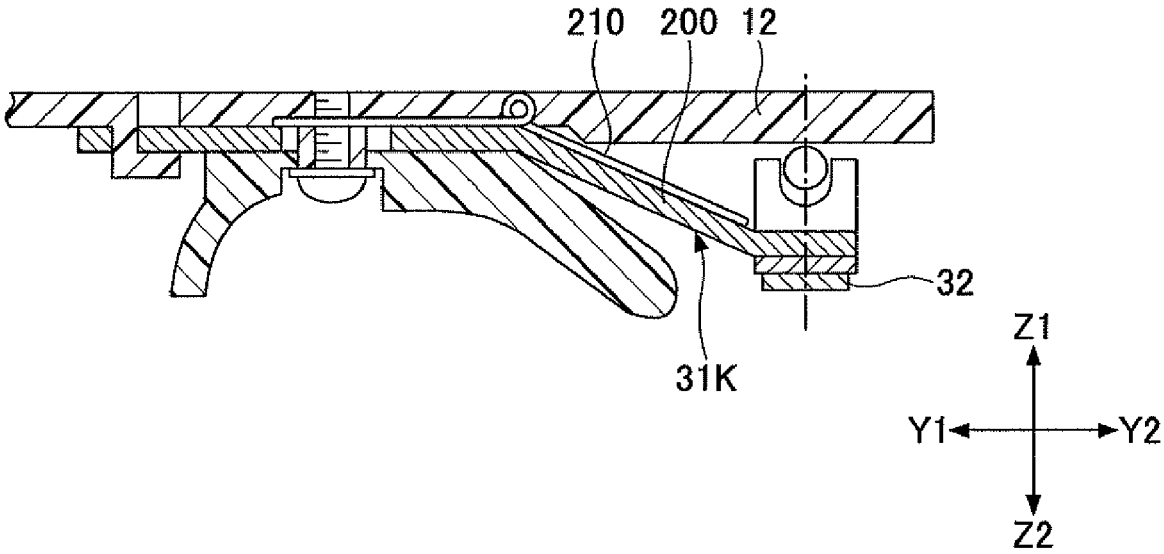

FIGS. 30A and 30B are a perspective view and a cross sectional view illustrating the second modification of the thermal head assembly. A thermal head assembly 31K uses a torsion spring 210 in place of the compression coil springs 201. The torsion spring 210 has an approximate U-shape, and a bridge part 201*a* of the torsion spring 210 traverses the plate member 200 to stably apply the head pressure.

Figure 31:
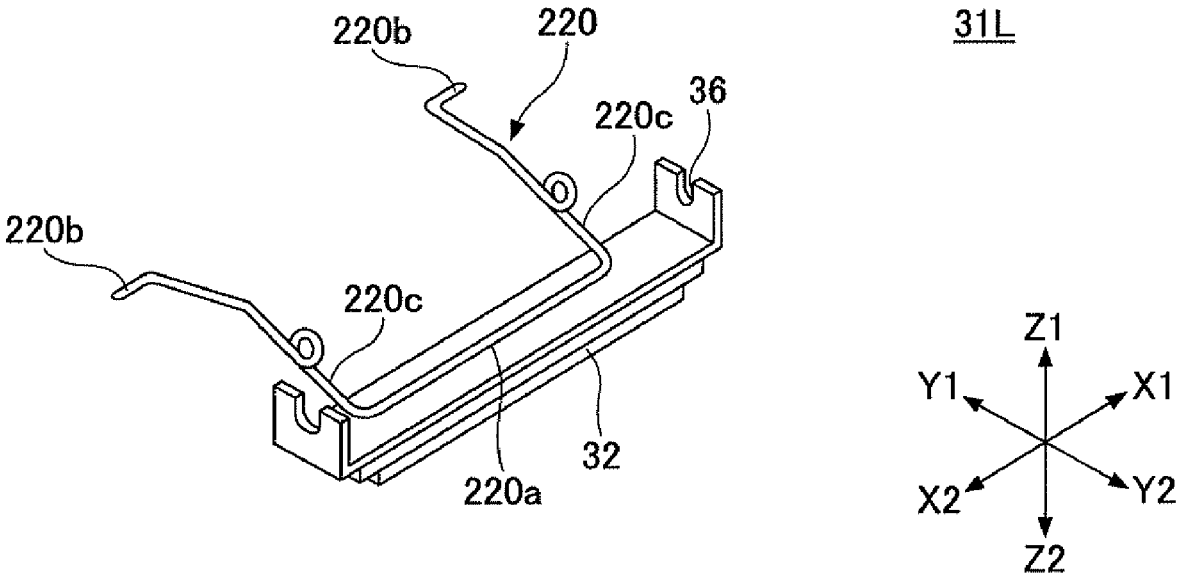
FIG. 31 is a perspective view illustrating a third modification of the thermal head assembly.

FIG. 31 is a perspective view illustrating a third modification of the thermal head assembly. A thermal head assembly 31L has the thermal head 21 mounted on a bridge part 220*a* that is provided on the tip end side of a torsion spring 220 having an approximate U-shape. A base part 220*b* of the torsion spring 220 is mounted on the plate part of the housing. The thermal head 32 is supported along the entire length thereof along the X1-X2 direction by the bridge part 220*a* of the torsion spring 220. In addition, spring forces generated by two arm parts 220*c* located on both sides of the bridge part 220*a* are applied on the thermal head 32 via the bridge part 220*a* to stably apply the head pressure.

Of course, in each of the embodiments and modifications, a head that is used is not limited to the thermal head, and any suitable type of printing head may be used in place of the thermal head.

Further, the present invention is not limited to these embodiments, but various variations and modifications may be made without departing from the scope of the present invention.

What is claimed is

1. A printer module for a clam-shell type printing apparatus having a lid that opens and closes with respect to a housing, said printer module comprising:

a head assembly including a head and mounted on the housing;

a platen roller mounted on the lid; and a main assembly including a frame, and a motor mounted on the frame and configured to rotate the platen roller, wherein the main assembly is mounted on the housing to cover the head assembly, and wherein the frame includes:

a pair of mutually confronting side plate parts;

a bridging part bridging the pair of side plate parts; and a locking cutout part, located on one side relative to the bridging part, configured to engage and lock a shaft of the platen roller when the lid is closed.

2. The printer module as claimed in claim 1, wherein the frame has a reference projection;

the head assembly has a recess configured to engage the reference projection fits; and the head assembly is mounted on the housing in a state where the head assembly is positioned with respect to the frame by the reference projection which fits into the recess.

3. The printer module as claimed in claim 1, wherein the pair of side plate parts and the bridging part form a paper roll accommodating space configured to accommodate a paper roll.

4. The printer module as claimed in claim 3, wherein the frame includes an extension part extending in a direction opposite to the paper roll accommodating part from the bridging part; and the motor is mounted on the extension part.

5. The printer module as claimed in claim 4, wherein the extension part is provided on the frame at a position corresponding to the locking cutout part.

6. The printer module as claimed in claim 3, wherein the frame includes an extension part extending in a direction opposite to the locking cutout part relative to the bridging part; and the motor is mounted on the extension part.

7. The printer module as claimed in claim 3, wherein the side plate part includes an extension part extending with respect to the paper roll accommodating part in a direction opposite to a part where the lid is locked when closed; and the motor is mounted on the extension part and a portion of the motor enters the paper roll accommodating part.

8. The printer module as claimed in claim 3, wherein the side plate part includes an extension part extending with respect to the paper roll accommodating part in a direction opposite to a part where the lid is locked when closed;

the bridging part includes a motor cover; and the motor is mounted on the extension part and is covered by the motor cover.

9. The printer module as claimed in claim 1, further comprising:

a holder configured to engage a shaft of the platen roller and surround the platen roller to form a platen roller assembly;

wherein the frame includes a holder guide part opposing a corner part of the holder; and wherein a portion of the holder moves along the holder guide part to displace the holder when the holder is turned in a state where the shaft of the platen roller is engaged and locked by the locking cutout part, to thereby cause the shaft of the platen roller to escape from the locking cutout part.

10. The printer module as claimed in claim 9, wherein the holder includes a paper jam preventing part configured to prevent a paper roll from jamming an entrance of a paper passage through which paper from the paper roll is supplied, in a state where the lid is closed.

11. The printer module as claimed in claim 9, wherein the holder includes an operation part that extends outwards from the holder and is manipulated when turning the holder.

12. The printer module as claimed in claim 1, wherein the head assembly includes a leaf spring member having the head mounted on a tip end thereof; and further comprising:

a gear mechanism configured to transmit rotation of the motor to the platen roller.

13. The printer module as claimed in claim 12, wherein the main assembly includes the gear mechanism.

14. The printer module as claimed in claim 12, wherein the leaf spring member includes a flange part, and the gear mechanism is mounted on the flange part.

15. The printer module as claimed in claim 12, wherein the leaf spring member includes a base part mounted on the housing.

16. The printer module as claimed in claim 1, wherein the head assembly includes a torsion spring member having the head mounted on a tip end thereof.

17. An electronic apparatus comprising:

a housing; and a printer module for a clam-shell type printing apparatus having a lid that opens and closes with respect to the housing, said printer module comprising:

a head assembly including a head and mounted on the housing;

a platen roller mounted on the lid; and a main assembly including a frame, and a motor mounted on the frame and configured to rotate the platen roller, wherein the main assembly is mounted on the housing to cover the head assembly, and wherein the frame includes:

a pair of mutually confronting side plate parts;

a bridging part bridging the pair of side plate parts; and a locking cutout part, located on one side relative to the bridging part, configured to engage and lock a shaft of the platen roller when the lid is closed.

18. The electronic apparatus as claimed in claim 17, wherein the pair of side plate parts and the bridging part form a paper roll accommodating space configured to accommodate a paper roll.

19. The electronic apparatus as claimed in claim 17, further comprising:

the clam-shell type printing apparatus.

* * * * *